US006589070B1

(12) United States Patent
Lias et al.

(10) Patent No.: US 6,589,070 B1
(45) Date of Patent: Jul. 8, 2003

(54) CIRCUIT BREAKER JUMPER ASSEMBLY WITH PHASE ISOLATION

(75) Inventors: Edward Ethber Lias, Aliquippa, PA (US); Michael Jerome Whipple, Rochester, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/067,193

(22) Filed: Feb. 4, 2002

(51) Int. Cl.[7] ..... H01R 31/08
(52) U.S. Cl. ..... 439/507; 439/715; 439/724
(58) Field of Search ..... 439/507, 715, 439/724, 514, 709, 722, 212, 213, 710, 711, 712, 713, 714, 717, 721, 716, 718, 719, 720, 47, 48, 44; 361/637, 638, 639, 640, 822, 823, 824

(56) References Cited

U.S. PATENT DOCUMENTS

| | | | | |
|---|---|---|---|---|
| 3,909,097 A | | 9/1975 | Roth et al. | |
| 3,941,443 A | | 3/1976 | Reimer | |
| 4,603,376 A | * | 7/1986 | Maier | 361/426 |
| 4,785,378 A | | 11/1988 | Hinckley et al. | |
| 5,064,384 A | | 11/1991 | Weaver | |
| 5,403,210 A | * | 4/1995 | Hasegawa | 439/723 |
| 6,036,554 A | | 3/2000 | Koeda et al. | |

OTHER PUBLICATIONS

OEM, "Commercial and Industrial Circuit Breakers for OEM Applications," pp. 1–16, Square D Groupe Schneider (1998) USA.

* cited by examiner

*Primary Examiner*—Ross Gushi
(74) *Attorney, Agent, or Firm*—Martin J. Moran

(57) ABSTRACT

A jumper assembly that includes a housing assembly and at least two bus assemblies. The housing assembly has a planar member and a plurality of upper and lower side walls extending generally perpendicular from opposite sides of the planar member. The housing assembly planar member has an upper side and a lower side with one or more openings passing therethrough. The at least two or more bus assemblies each have a planar bus member and one or more collar assemblies coupled to each planar bus members. The upper side walls form two or more separate upper raceways. The lower side walls form two or more lower raceways. The bus planar members are disposed in the lower raceways. The collars disposed in the upper raceways and coupled to the bus planar members through the housing assembly planar member openings. Thus, a first power line may pass through a first upper raceway to be coupled to a first collar assembly attached to a first bus assembly; and a second power line may pass through a second upper raceway to be coupled to a second collar assembly attached to a second bus assembly. Therefore the first and second power lines are isolated from each other.

3 Claims, 33 Drawing Sheets

CIRCUIT BREAKER JUMPER ASSEMBLY WITH PHASE ISOLATION

CROSS REFERENCE TO RELATED APPLICATION

This application is related to the applications CIRCUIT BREAKER JUMPER ASSEMBLY WITH SNAP-FIT BUS MOUNTING Ser. No. 10/066,896, CIRCUIT BREAKER JUMPER ASSEMBLY WITH COVER ASSEMBLY ACCESS KNOCKOUTS Ser. No. 10/067,022, CIRCUIT BREAKER JUMPER ASSEMBLY WITH A SNAP-FIT COVER ASSEMBLY Ser. No. 10/066,924, CIRCUIT BREAKER JUMPER ASSEMBLY HAVING BUSSES IN A SINGLE PLANE Ser. No. 10/066,878, CIRCUIT BREAKER JUMPER ASSEMBLY HAVING A MODULAR DESIGN STRUCTURED FOR SINGLE AND THREE PHASE OPERATION Ser. No. 10/066,919, and MULTI-UNIT CIRCUIT BREAKER JUMPER ASSEMBLY Ser. No. 10/067,066.

BACKGROUND OF THE INVENTION

1. Field of the Invention

This invention relates to a jumper assembly used in conjunction with two circuit breakers, more specifically to a jumper assembly where the power lines and bus assemblies having different phases are isolated from each other.

2. Background Information

A jumper assembly is a device for dividing a current from a power line so that the current may be directed to two or more circuit breakers. The jumper assembly includes a non-conductive housing and two conductive buses. The current is divided by coupling the power line to a single input point, typically a collar assembly, on a bus having two or more output terminals. The output terminals are then coupled to two different circuits, each of which has its own circuit breaker. The circuit breakers on the different circuits typically have different ratings. At typical jumper assembly is disclosed in U.S. Pat. No. 5,064,384.

As shown in FIG. 1, which is the same as FIG. 9 in the U.S. Pat. No. 5,064,384, the prior art jumper included a first bus bar, a second bus bar and a non-conductive housing. Each bus bar had a collar that is structured to be coupled to a power line. Each bus bar has multiple output terminals. The bus bars are not isolated from each other. That is, as shown on FIG. 6 of the U.S. Pat. No. 5,064,384, both bus bars are exposed to the interior of the housing. When power lines are coupled to the bus bars as shown on FIG. 9 of the U.S. Pat. No. 5,064,384, great care must be taken to ensure that the insulation on the power line coupled to the upper bus bar is intact as this power line lies directly over top of the lower bus bar. It would be better to have a jumper assembly where the bus assemblies are isolated from each other to reduce the risk of creating a short between a power line and a non-associated bus.

There is, therefore, a need for a jumper assembly having separate raceways for each power line.

There is a further need for a assembly having separate raceways for each bus assembly.

SUMMARY OF THE INVENTION

These needs, and others, are satisfied by the invention which provides a jumper assembly that includes a housing assembly and at least to bus assemblies. The housing assembly has a planar member and a plurality of upper and lower side walls extending generally perpendicular from opposite sides of the planar member. The housing assembly planar member has an upper side and a lower side with one or more openings passing therethrough. The at least two or more bus assemblies each have a planar bus member and one or more collar assemblies coupled to each planar bus members. The upper side walls form two or more separate upper raceways. The lower side walls form two or more lower raceways. The bus planar members are disposed in the lower raceways. The collars disposed in the upper raceways and coupled to the bus planar members through the housing assembly planar member openings. Thus, a first power line may pass through a first upper raceway to be coupled to a first collar assembly attached to a first bus assembly; and a second power line may pass through a second upper raceway to be coupled to a second collar assembly attached to a second bus assembly. Therefore the first and second power lines are isolated from each other. Additionally, the lower raceways are separate from each other, thus, the bus assemblies are also isolated from each other.

BRIEF DESCRIPTION OF THE DRAWINGS

A full understanding of the invention can be gained from the following description of the preferred embodiments when read in conjunction with the accompanying drawings in which:

FIG. 14C is an exploded isometric view of the fourth sized module.

DESCRIPTION OF THE PREFERRED EMBODIMENTS

Figure 1:
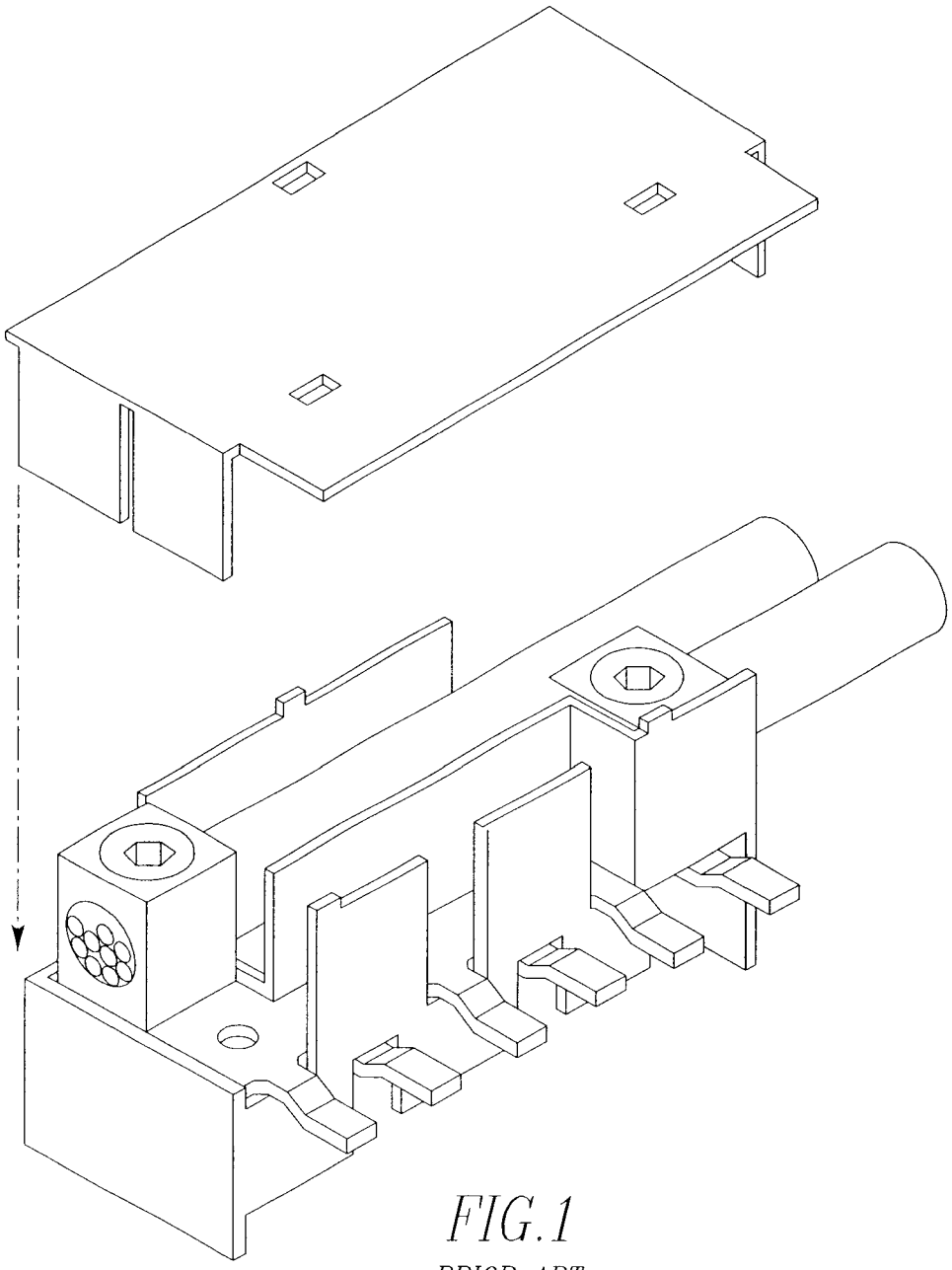
FIG.1 PRIOR ART
FIG. 1 is an isometric view of a six-terminal prior art jumper assembly.

As shown in FIGS. 2–6, a modular jumper assembly 100 includes one or more jumper modules, a first sized module 102, (FIGS. 7A–7G) a second sized module 104 (FIGS. 8A–8G), and a third sized module 106 (FIGS. 9A–9G) which are coupled together in a nested configuration. As will be detailed below, each module 102, 104, 106 includes a housing assembly 130, 330, 500 and a bus assembly 180, 440, 640. The combined module housing assemblies 130, 330, 500, when joined as described below, from the jumper assembly. Each bus assembly 180, 440, 640 includes two terminal ends 110, 112 that extend beyond the housing assemblies 130, 330, 500. All terminal ends 110, 112 extend from one side of the modular jumper assembly 100. As used herein, the side of the modular jumper assembly 100 or the modules 102, 104, 106 from which the terminal ends 110, 112 extend is the "front side". As used herein, the side of the modular jumper assembly 100 or the modules 102, 104, 106 opposite the front side is the "back side." Accordingly, as viewed from the front side, the side of the modular jumper assembly 100 or the modules 102, 104, 106 to the left is the "left side" and the side to the right is the "right side." Additionally, as used herein, the bus assemblies will be said to extend in a generally horizontal direction. Accordingly, a plane perpendicular to the horizontal directions shall be identified as the vertical direction.

Figure 6:
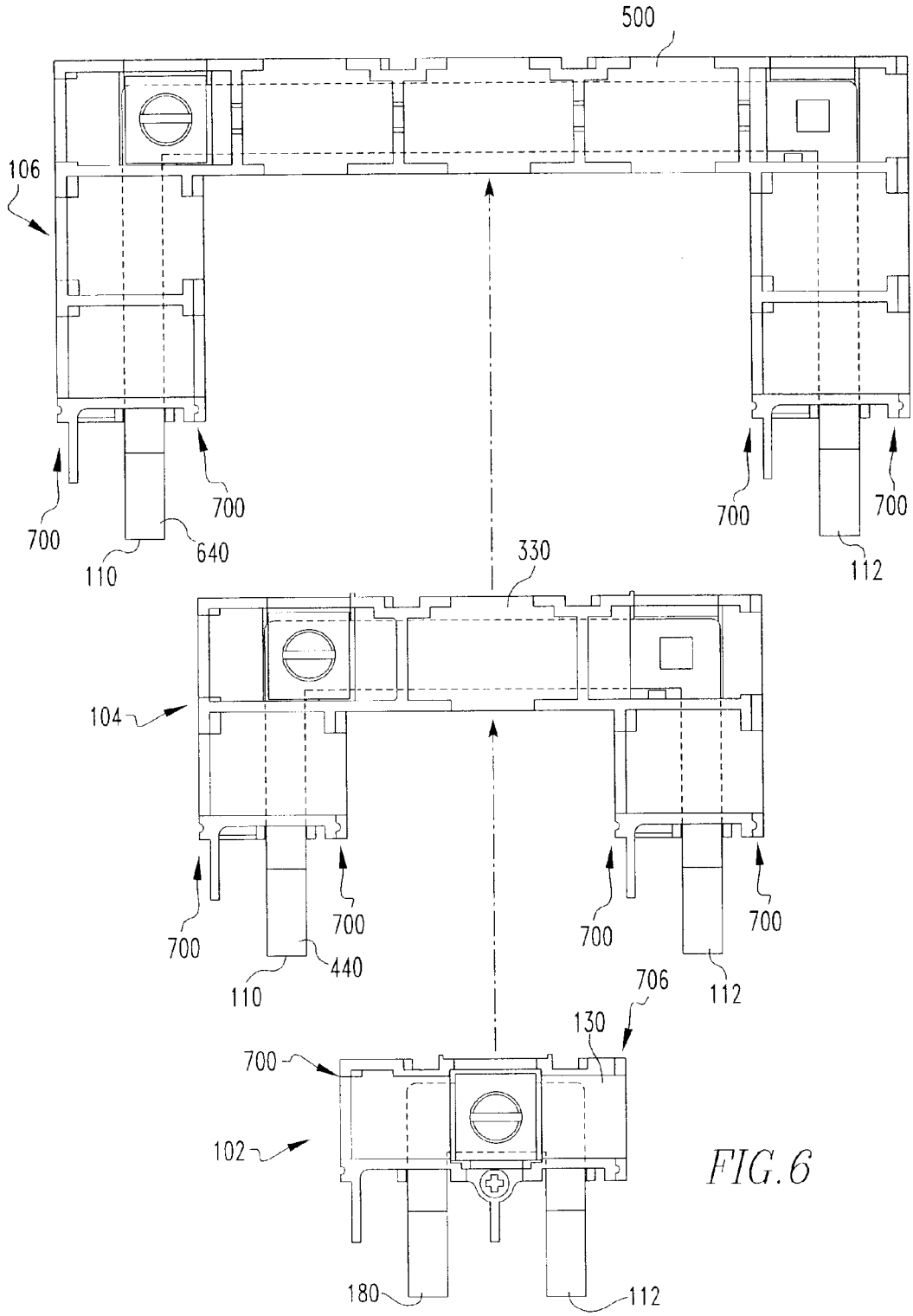
FIG. 6 is an exploded top view of the modular jumper assembly showing three modules.

As shown best in FIG. 6, the first size module 102 includes a generally linear or rectangular housing assembly 130 (described below). The second size module 104 has a generally U-shaped housing assembly 330 having a base portion 334, a left extension 336 and a right extension 338 (described below). The second size module 104 is sized so that the first size module 102 can fit between, i.e., be nested between, the second module left and right extensions 336, 338. The third size module 106 also has a generally U-shaped housing assembly 500, having a base portion 504, a left extension 506 and a right extension 508. The third sized module 106 is sized such that the second sized module 104 fits between, or is nested between, the third size module left and right extensions 506, 508. The modular jumper assembly 100 is generally symmetrical about a centerline 101 extending through the middle of the first sized module 102 and perpendicular to the front side.

Figure 3:
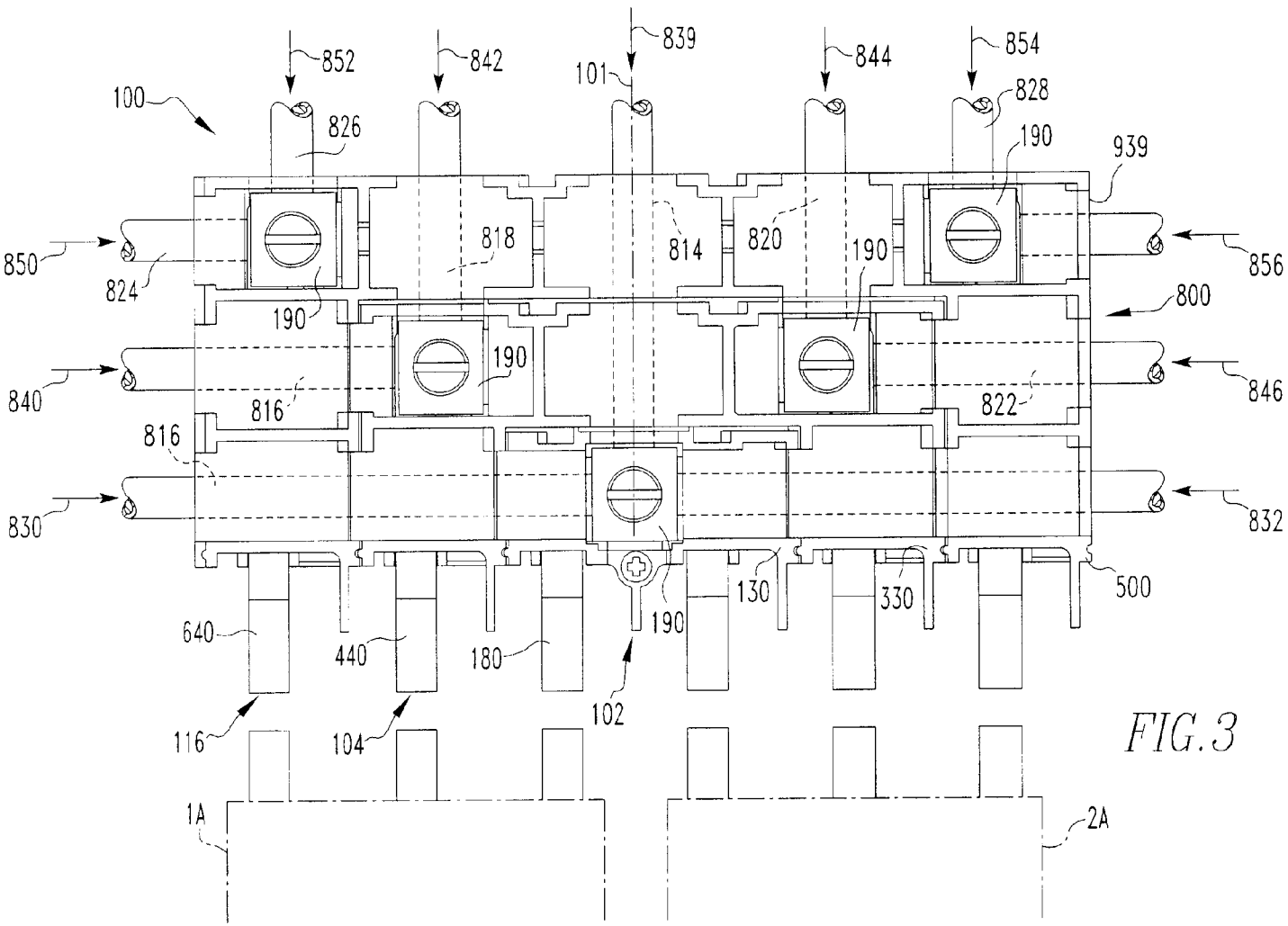
FIG. 3 is a top plan view of the modular jumper assembly.

The terminal ends 110, 112 of the bus assemblies 180, 440, 640 are structured to engage two circuit breakers 1, 2 (FIG. 3). That is, the terminal ends 110 on one side of a centerline 101 engage a first circuit breaker 90, while the terminal ends 112 on the other side of the centerline 101 engage a second circuit breaker 92. If the jumper assembly 100 includes three modules 102, 104, 106, the jumper assembly 100 can engage two separate three-phase circuit breakers 1A, 2A. Alternatively, the jumper assembly may only include two modules, typically the first sized module 102 and the second sized module 104, and engage two separate two-line circuit breakers 1B, 2B.

Figure 7A:
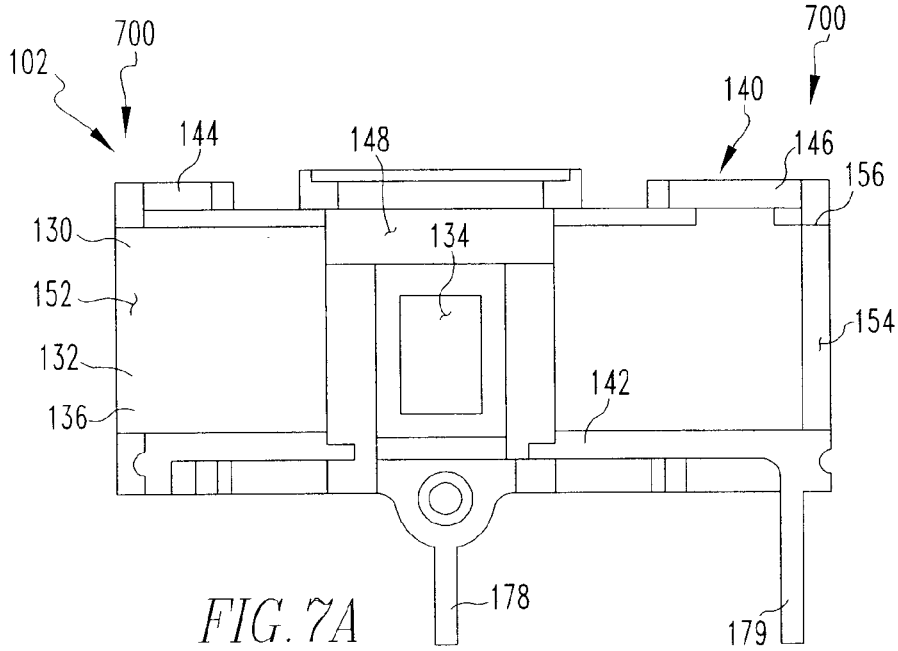
FIG. 7A is a top view of the first size module.
Figure 7E:
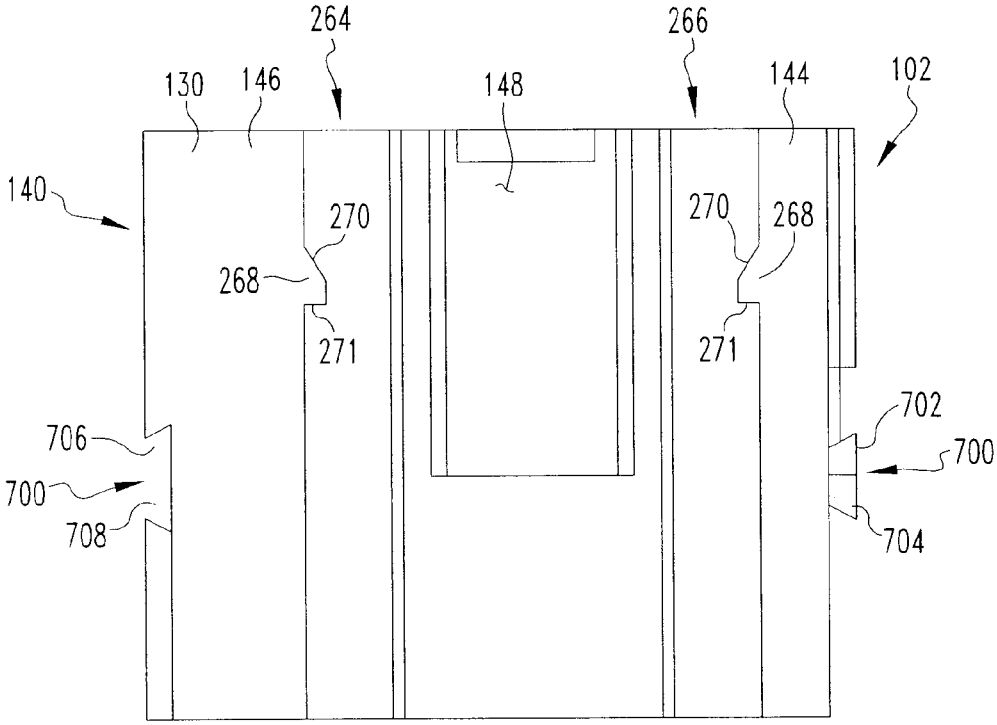
FIG. 7E is a back side view of the first size module.
Figure 7C:
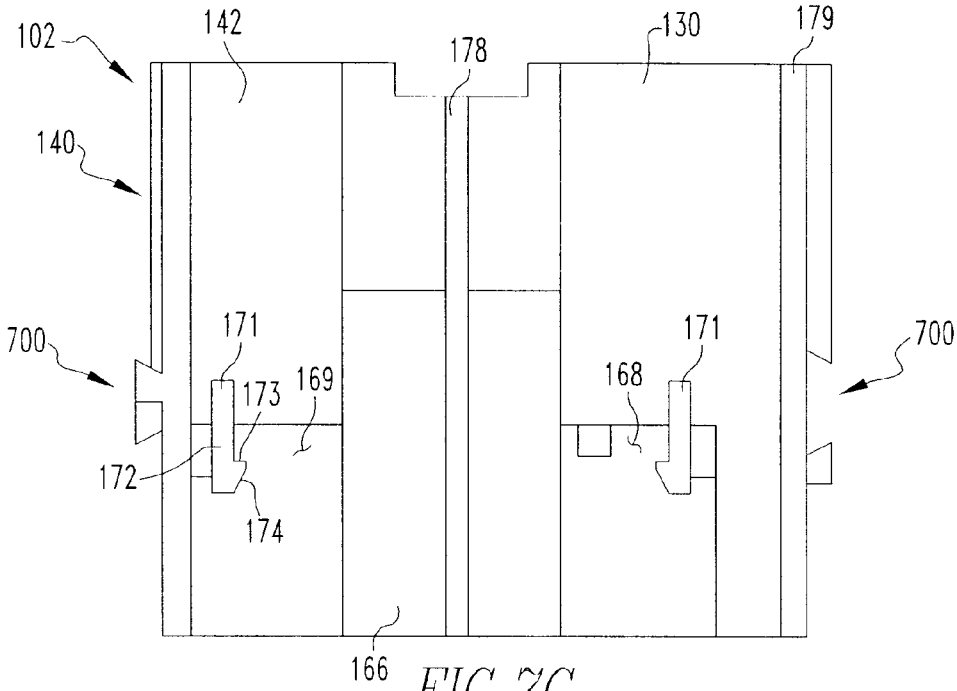
FIG. 7C is a front view of the first size module.
Figure 7B:
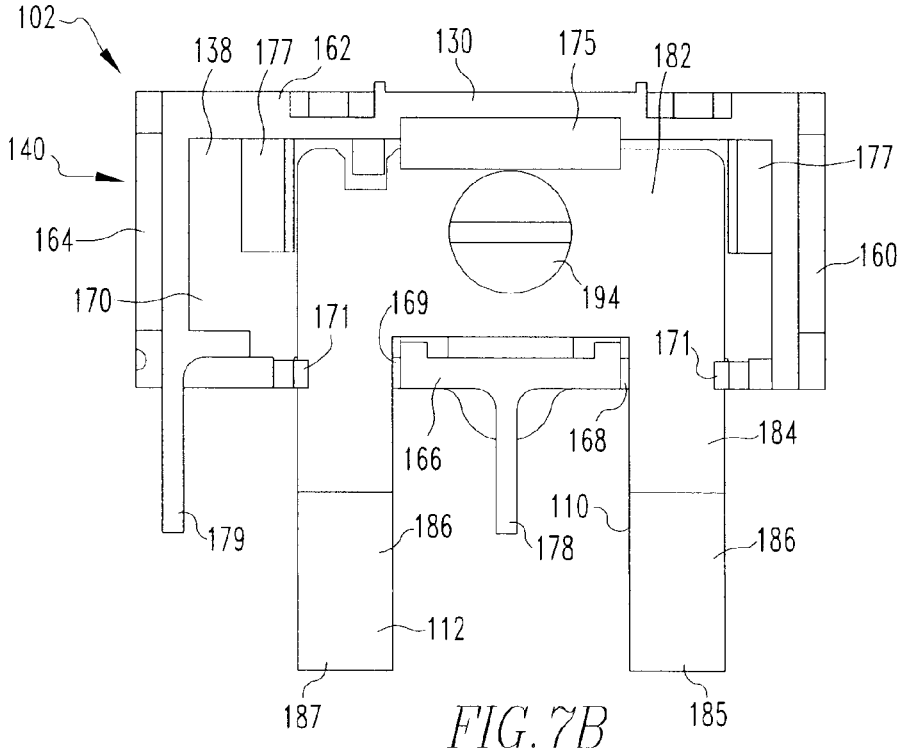
FIG. 7B is a bottom view of the first size module.
Figure 7D:
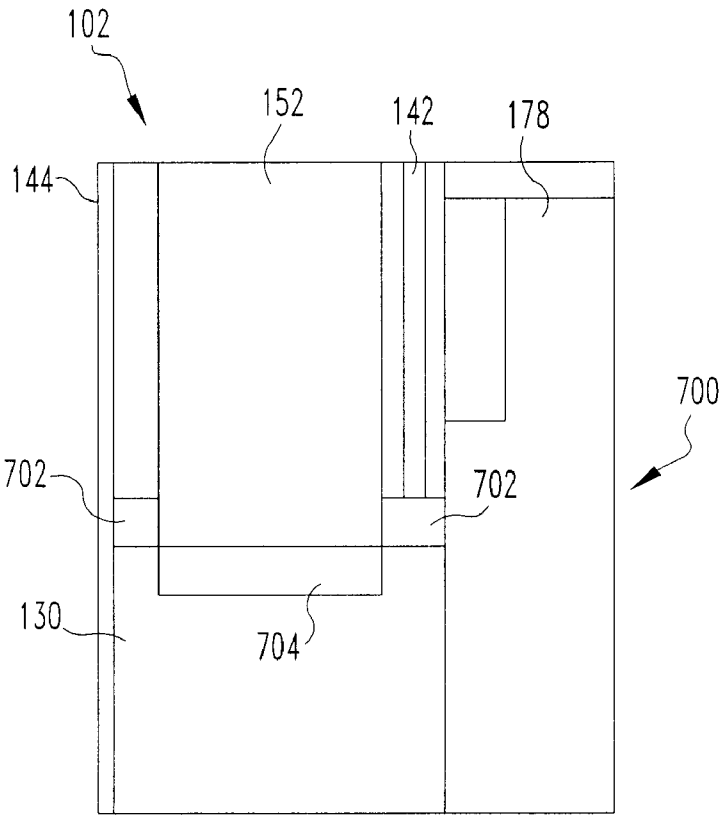
FIG. 7D is a left side view of the first size module.
Figure 7F:
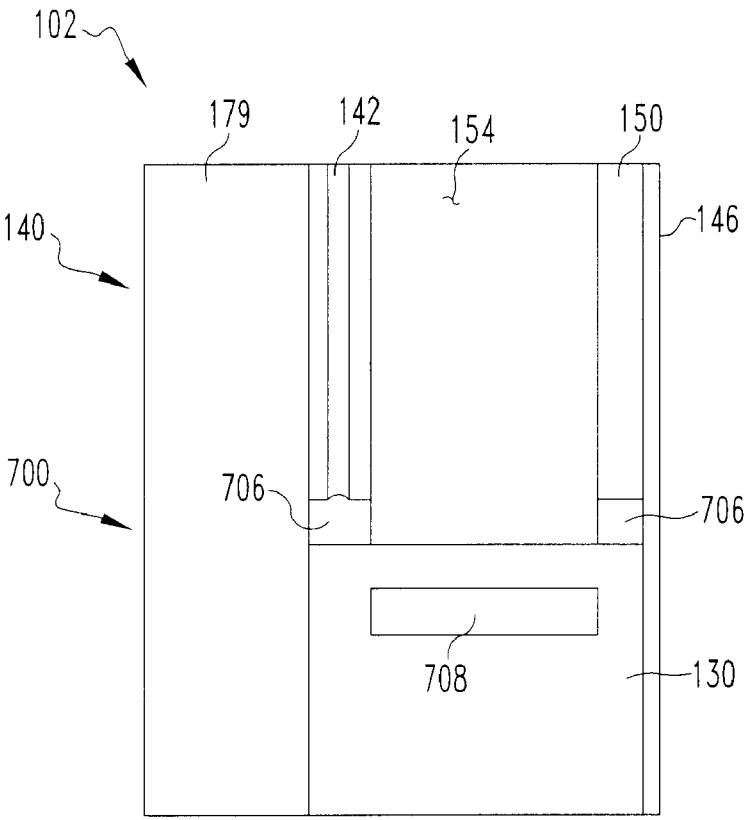
FIG. 7F is a right side view of the first size module.
Figure 7G:
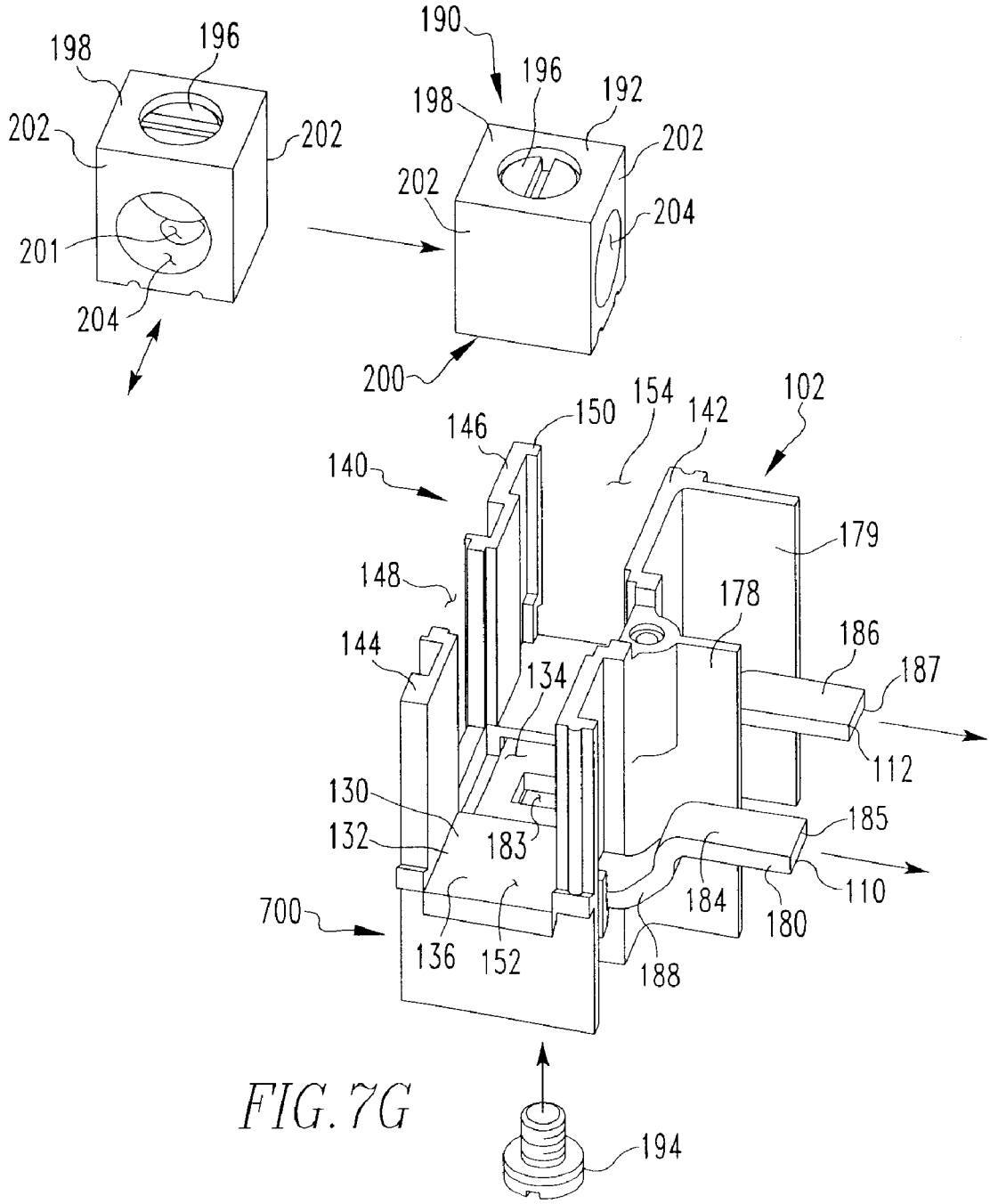
FIG. 7G is an exploded isometric view of the first size module.

As shown in FIGS. 7A–7G, the first size module 102 has a housing assembly 130, and a bus assembly 180 (FIGS. 7B, 7G). The first sized module housing assembly 130 is made from a non-conductive material. The first sized module housing assembly 130 includes a horizontal generally rectangular planar member 132 having a medial opening 134. The first sized module planar member 132 has an upper side 136 and a lower side 138. A plurality of side walls 140 extend upwards from the perimeter of the first sized module housing planar member upper side 136 and downward from the first sized module planar member lower side 138. The side walls 140 have, generally, either a uniform height or depth. The height of the first sized module housing upper side walls is between about ½ to 2.0 inches and preferably about 1.0 inch. The depth of the first sized module housing lower side walls is between about ⅛ to 1⅝ inches and preferably about ⅝ inches. The first sized module housing upper side walls include a front side wall 142, a left-back side wall 144, and a right-back side wall 146. The first sized module upper front side wall 142 extends left to right across the front side of the first sized module housing planar member 132. The first sized module upper left-back side wall 144 extends left to right along the left most portion of the first sized module housing planar member 132 back side. The first sized module upper right-back side wall 146 extends right to left along the right most portion of the first sized module housing planar member 132 back side. Between the first sized module upper left-back side wall 144 and the first sized module upper right-back side wall 146 is a first sized module back side upper medial opening 148. A tab 150 extends generally perpendicularly to the right side of the first sized module upper right back side wall 146. The tab 150 on the first sized module upper right back side wall 146 extends toward the front side. Thus, the first sized module front side wall 142 and the left back side wall 144 and the first sized module front side wall 142 and the tab 150 define a first sized module left side opening 152 and a first sized module right side opening 154, respectively.

As shown best on FIG. 7B, the first sized module housing lower side walls include a first sized module lower left side wall 160, a first sized module lower back side wall 162, a first sized module lower right side wall 164, and a first sized module lower front medial side wall 166. The first sized module lower left side wall 160, the first sized module lower back side wall 162, and the first sized module lower right side wall 164 extend along the entire perimeter of the of the first sized module housing planar member 132 left side, back side and right side, respectively. The first sized module lower front medial side wall 166, however, only extends left to right along the central portion of the first sized module housing planar member 132 front side. Thus, there is a first sized module lower left front opening 168 between the first sized module lower front medial side wall 166 and the first sized module lower left side wall 160 and a first sized module lower right front opening 169 between the first sized module lower medial front side wall 166 and the lower right side wall 164. The first sized module lower side walls 160, 162, 164, 166 define a first sized module lower bus raceway 170.

Figure 10:
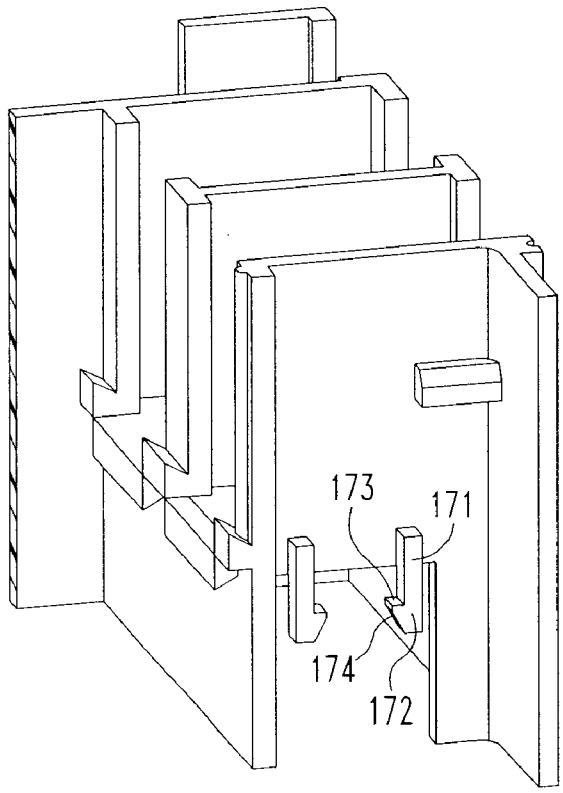
FIG. 10 is a detail view of a bus assembly clip.
Figure 11:
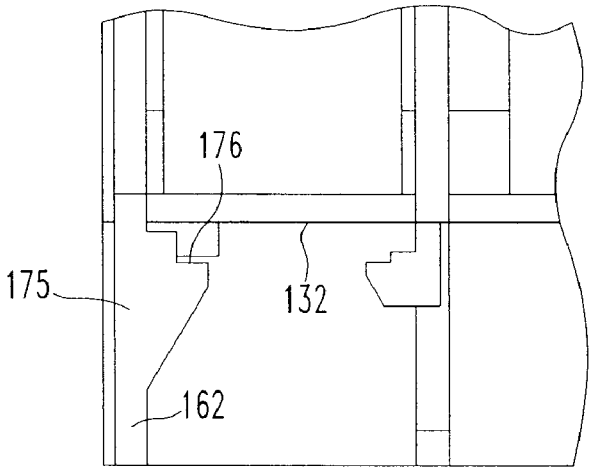
FIG. 11 is a detail view of a bus assembly mounting boss.

Two bus assembly clips 171, as detailed in FIG. 10, are located along the lower front side of the first sized module planar member 132, one clip 171 in each opening 168, 169. Each clip 171 extends from the first sized module housing planar member lower surface 138 and include an elongated flexible stem 172, a perpendicular latching surface 173, and an angled lower surface 174. The first size module lower back side wall 162 includes a bus assembly mounting boss 175. The mounting boss 175, as detailed in FIG. 11, is a protuberance extending from the front fact of the first sized module lower back side wall 162 and having a flat surface 176 parallel to the first sized module housing planar member 132. The flat surface 176 is spaced, about the height of the first sized module bus assembly planar member 182 (described below), apart from the first sized module housing planar member 132. There may also be a bus assembly alignment guide 177 extending from the planar member lower side 138. The bus assembly alignment guide 177 is a protuberance having a angled lower surface.

Additionally, there are two first sized module front spacers 178, 179. One spacer 178 extends toward the front from the first sized module upper front side wall 142 and the first sized module lower front medial side wall 166. The other spacer 179 extends toward the front from the upper front side wall 142 at the front right corner and is an extension of the first sized module lower right side wall 164. The spacers 178, 179 run vertically and protrude from the first sized module front side walls 142, 166 less distance than the first sized module bus assembly terminals 184, 186 (described below).

As shown best in FIG. 7G, the first sized module bus assembly 180 includes a generally rectangular and planar member 182, two terminals 184, 186, and a collar assembly 190. The first sized module bus assembly planar member 182 includes a medial opening 183. The two terminals 184, 186 are joined at one end to the first sized module bus assembly planar member 182 and each has a planar distal end 185, 187. The terminals 184, 186 may have a bent portion 188 that shifts the planar distal ends 185, 187 out of the plane of the first sized module bus assembly planar member 182. The collar assembly 190 includes a collar assembly body 192, a mounting device 194 and a fastening device 196. The collar assembly body 192 is generally cube shaped having a top surface 198, a bottom surface 200 and four sides 202. The collar assembly body 192 has a side opening 204 on at least one of the four sides 202. The collar body top surface 198 includes a threaded opening 201. The collar assembly fastening device 196 has threads corresponding to the top surface threaded opening and is disposed therein. The collar assembly fastening device 196 is structured to move into and out of the collar assembly body 192 so as to engage a power line 810 (described below). The collar assembly bottom surface 200 also includes a threaded opening (not shown). The collar assembly mounting device 194 is structured to engage the collar assembly bottom surface 200 threaded opening.

To assemble the first sized module 102, the back side of the first sized module bus planar member 182 is inserted between the mounting boss 175 and the first sized module housing planar member 132. Thus, the terminals 184, 186 pass through the first sized module lower left front opening 168 and first sized module lower right front opening 169. As the first sized module bus assembly planar member 182 contacts the angled lower surface of the bus assembly alignment guide 177, the bus assembly alignment guide 177 acts to centrally position the first sized module bus assembly 180 within the lower bus raceway 170. The first sized module bus assembly planar member 182 is then brought into face-to-face contact with the first sized module housing planar member lower side 138. As the first sized module bus assembly planar member 182 is brought into contact with the first sized module housing planar member lower side 138, each terminal 184, 186 contacts a bus assembly clip angled lower surface 174 causing the clip stem 172 to flex and allow the terminal 184, 186 to pass. Once the first sized module bus assembly planar member 182 in generally parallel to the first sized module housing planar member 132, the clip stem 172 will return to its original position. At this point, a clip latching surface 173 is adjacent to each terminal 184, 186. The first sized module bus planar member 182 is secured to the first sized module housing assembly 130 by positioning the collar assembly 190 over the upper side of the first sized module housing medial opening 134 while passing the collar assembly mounting device 194 through the first sized module bus planar member medial opening 183 and the first sized module housing medial opening 134 to engage the collar assembly bottom surface 200 threaded opening. Thus, the first sized module bus assembly 180 is coupled to the first sized module housing assembly 130 with the terminal ends 110, 112 extending beyond the first sized module housing assembly 130 front side.

As shown in FIGS. 8A–8G, the second size module 104 has a housing assembly 330, and a bus assembly 440. The second sized module housing assembly 330 is made from a non-conductive material and is generally symmetrical about a second sized module centerline 331. The second sized module housing assembly 330 includes a horizontal, generally U-shaped planar member 332 having a base portion 334, a left extension 336 and a right extension 338. Both the second sized module housing planar member left extension 336 and the second sized module housing planar member right extension 338 extend from the front side of the second sized module housing planar member base portion 334. A first opening 340 and a second opening 342 extend through the second sized module housing planar member base portion 334. The second sized module housing planar member first opening 340 is disposed adjacent to the second sized module housing planar member base portion 334 left side. The second sized module housing planar member second opening 342 is disposed adjacent to the second sized module housing planar member base portion 334 right side. The second sized module housing planar member has an upper side 350 and a lower side 352. A plurality of side walls 360 extend upwards from the perimeter of, and across, the second sized module housing planar member upper side 350 and downward from the second sized module housing planar member lower side 352. The side walls 360 have, generally, either a uniform height or depth. The height of the second sized module housing upper side walls is between about ½ to 2.0 inches and preferably about 1.0 inch. The depth of the second sized module housing lower side walls is between about ⅛ to 1⅝ inches and preferably about ⅝ inches.

Figure 8A:
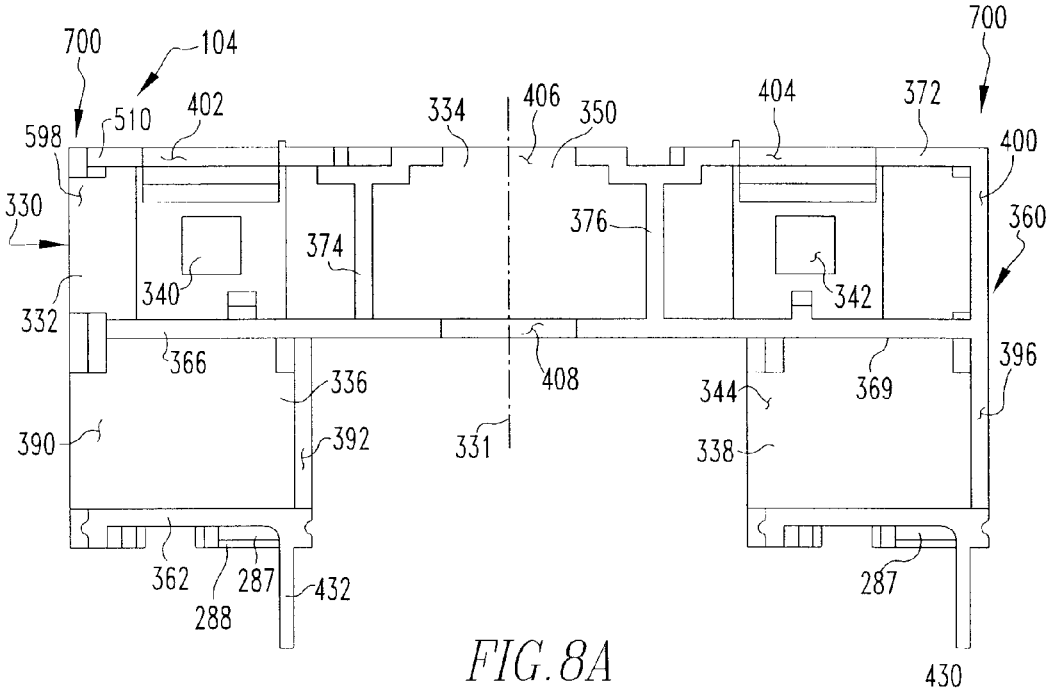
FIG. 8A is a top view of the second size module.

As shown best in FIG. 8A, the second sized module housing upper side walls include a left front side wall 362 extending left to right and disposed at the front side of the second sized module housing planar member left extension 336, a right front side wall 364 extending left to right and disposed at the front side of the second sized module housing planar member right extension 338, a left extension medial side wall 366 extending left to right and disposed between the second sized module housing planar member base portion 334 and the second sized module housing planar member left extension 336, a right extension medial side wall 368 extending left to right and disposed between the second sized module housing planar member base portion 334 and the second sized module housing planar member right extension 338, a left back side wall 370 extending left to right disposed at the left back side of the second sized module housing planar member base portion 334, and a right back side wall 372 extending right to left disposed at the right back side of the second sized module housing planar member base portion 334. A base portion upper left medial side wall 374 and a base portion upper right medial side wall 376 extend front to back between the front side and the back side of the second sized module housing planar member base portion 334. The second sized module housing base portion left medial wall 374 is disposed to the left side of the second sized module centerline 331. The base second sized module housing base portion upper right medial wall 376 is disposed to the right side of the second sized module centerline 231. As with the first sized module housing side walls 140, the second sized module upper side walls include tabs 380 which extend generally perpendicularly to the second sized module upper side walls 362, 364, 366, 368, 370, 372, 374, 376. Thus, there are tabs 380 extending towards the back from the left and right ends of both the left front side wall 362 and the right front side wall 364. Both the left and right second sized module housing base portion upper medial side walls 374, 376 have tabs 380 extending left to right along the perimeter of the second sized module housing base portion 334. The tabs 380 extend to both the left and the right of left second sized module housing base portion upper left medial side wall 374 as well as to both the left and the right of right second sized module housing base portion upper right medial side wall 376. The tab 380 on the front side of left second sized module housing base portion upper left medial side wall 374 extends leftward to become contiguous with left extension medial side wall 366. The tab 380 on the front side of right base portion upper left medial side wall 374 extends rightward to become contiguous with right extension medial side wall 368.

Thus, upper side walls define a plurality of openings. On the second sized module housing left extension 336 there is a left side opening 390 and a right side opening 392. On the second sized module housing planar member right extension 338 there is a left side opening 394 and a right side opening 396. On the second sized module housing planar member base portion 334 there is a left side opening 398, a right side opening 400, a back side left opening 402, a back side right opening 404, a back side medial opening 406, and a front side medial opening 408.

Figure 8E:
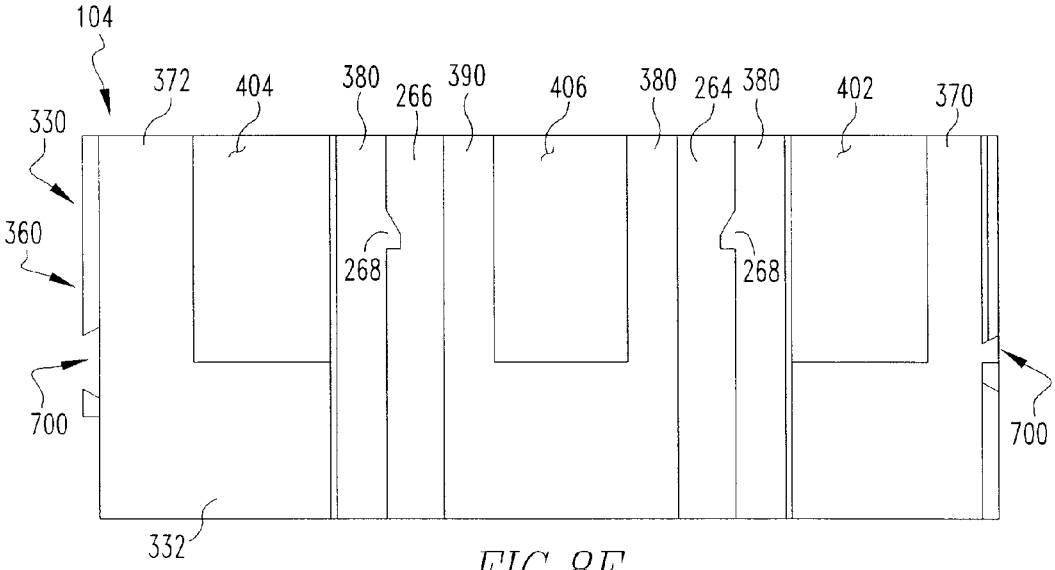
FIG. 8E is a back side view of the second size module.
Figure 8C:
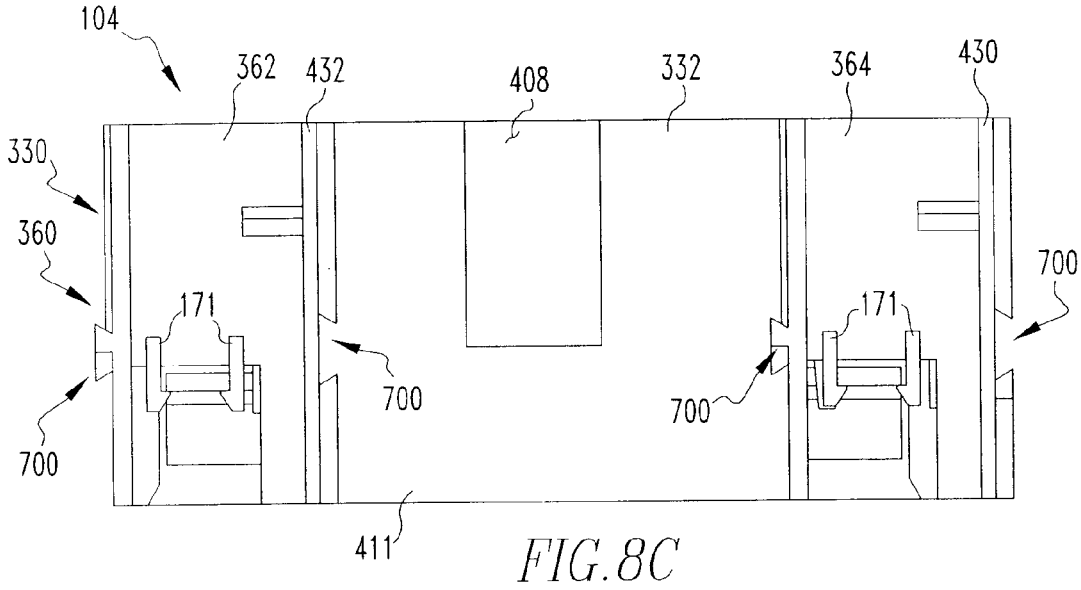
FIG. 8C is a front view of the second size module.
Figure 8B:
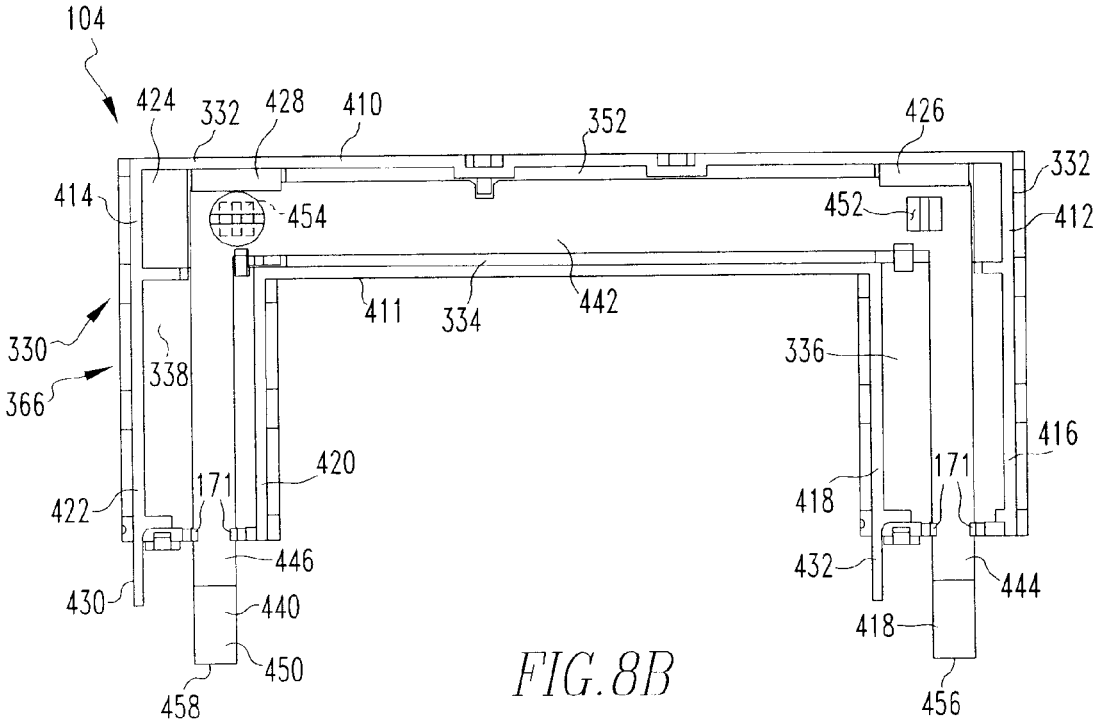
FIG. 8B is a bottom view of the second size module.
Figure 8F:
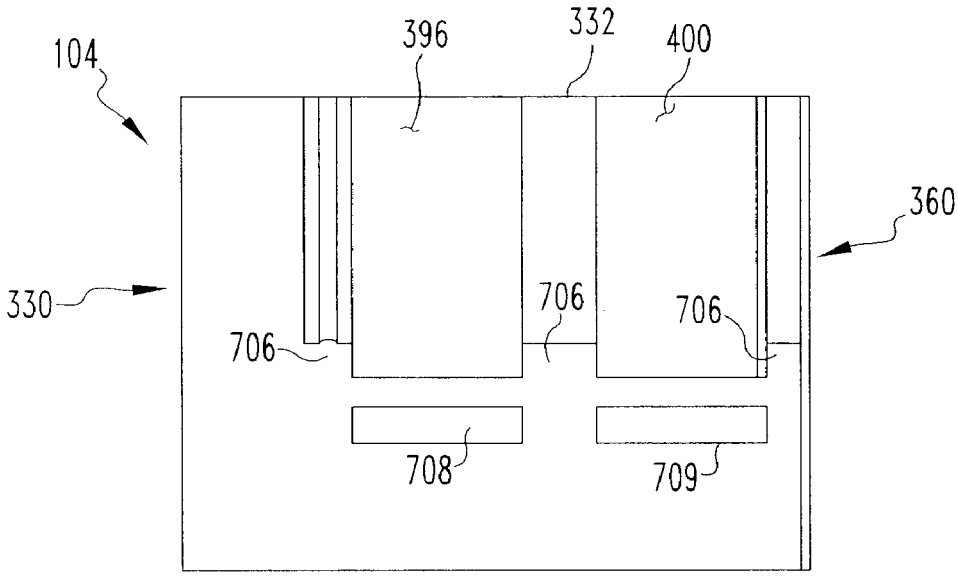
FIG. 8F is a right side view of the second size module.
Figure 8D:
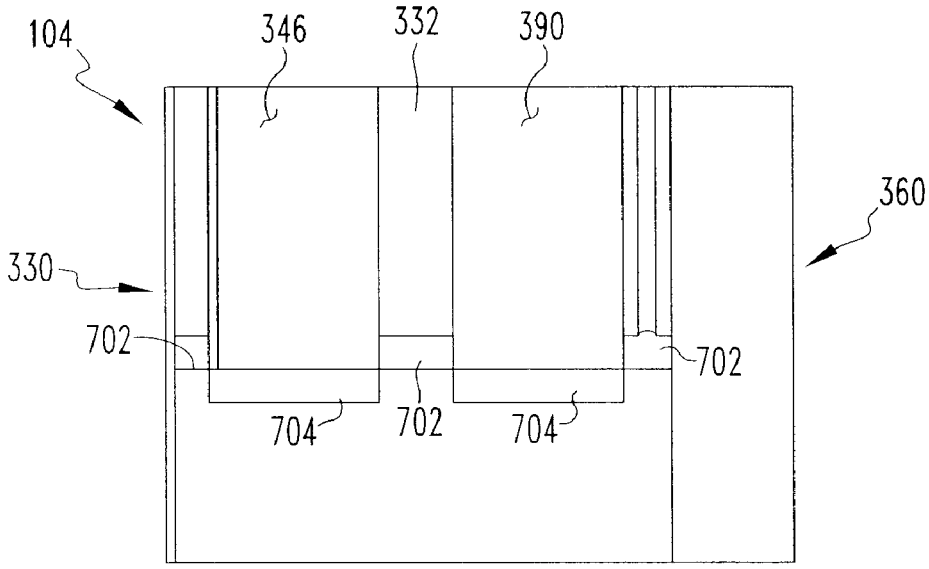
FIG. 8D is a left side view of the second size module.
Figure 8G:
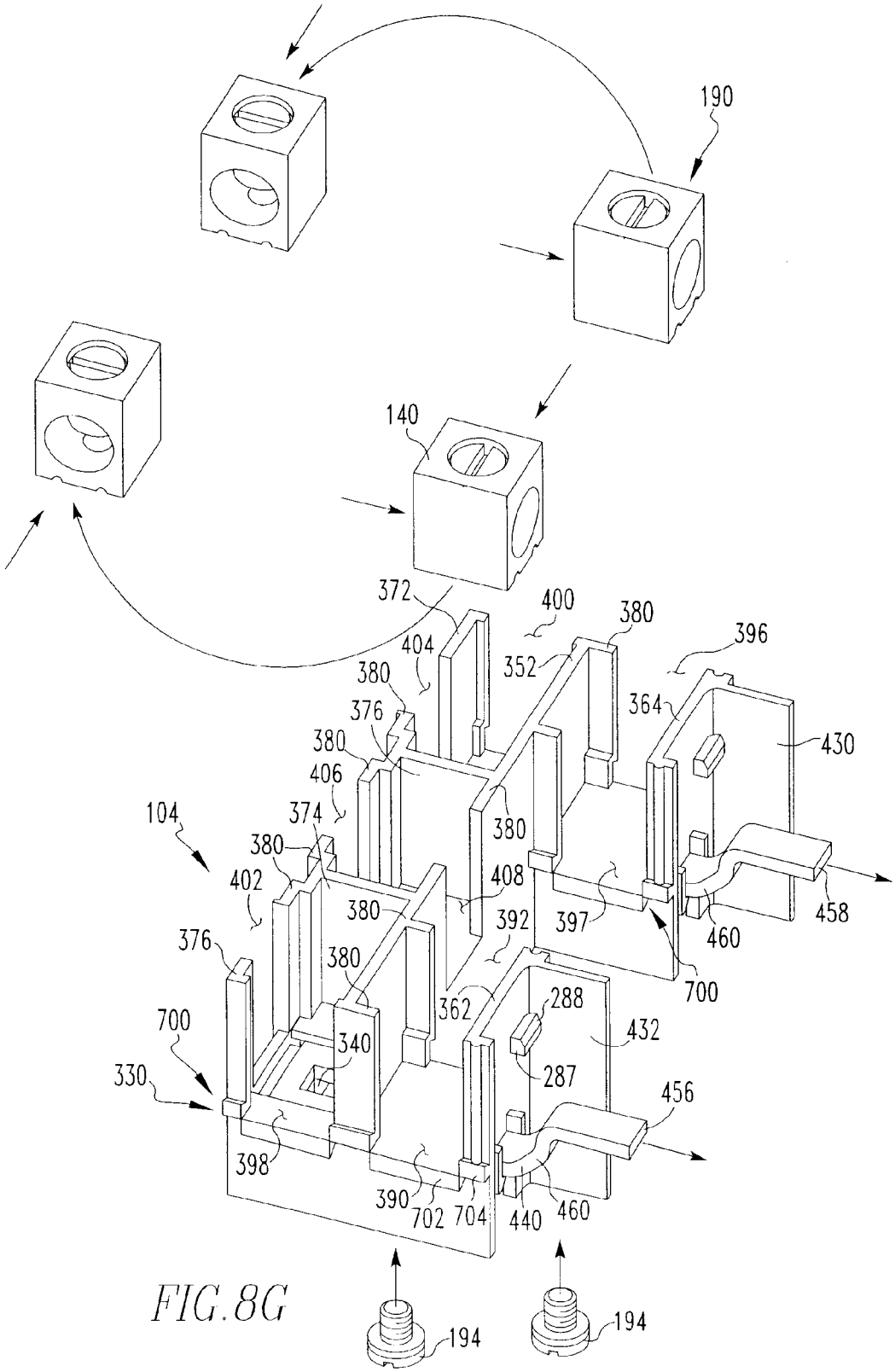
FIG. 8G is an exploded isometric view of the second size module.

As shown best in FIG. 8B, the second sized module housing lower side walls generally extend along the perimeter of the U-shaped planar member 332, except for the front side of both the left and right extensions 336, 338. Thus, there is a second sized module housing base portion lower back side wall 410, a second sized module housing base portion lower front side wall 411, a second sized module housing base portion lower left side wall 412, a second sized module housing base portion lower right side wall 414, a second sized module housing left extension lower left side wall 416, a second sized module housing left extension lower right side wall 418, a second sized module housing right extension lower left side wall 420, and a second sized module housing right extension lower right side wall 422. The second sized module lower side wall therefore define a U-shaped second sized module lower raceway 424. As with the first sized module 102, the front side of both the left and right extensions 336, 338 each include one or more bus assembly clips 171 used to secure the second sized module bus assembly 440. Additionally, there are two bus assembly mounting bosses 426, 428 located on the front face of the second sized module housing base portion lower back side wall 410. The second sized module bus assembly mounting bosses 426, 428 are substantially similar to the first sized module bus assembly mounting bus 175.

There are two second sized module front spacers 430, 432. One spacer 430 extends from the second sized module housing right side of the left extension upper front side wall 362 and is an extension of the second sized module housing left extension lower right side wall 418. The other spacer 432 extends from the right side of the second sized module housing right extension upper front side wall 364 and is an extension of the second sized module housing right extension lower right side wall 418. The second sized module front spacers 430, 432 run vertically and protrude from the second sized module housing front side walls 362, 364 less distance than the second sized module bus terminals 448, 450 (described below).

The second sized module bus assembly 440 includes a generally U-shaped planar member 441 having a base portion 442, a left extension 444, and a right extension 446. The second sized module bus planar member left and right extensions 444, 446 end in two terminals 448, and 450. The two terminals 448, 450 each have a planar distal end 456, 458. The terminals 448, 450 may have a bent portion 460 that shifts the planar distal ends 456, 458 out of the plane of the second sized module bus planar member 441. The second sized module bus assembly 440 further includes one or more collar assemblies 190. The second sized module bus planar member base portion 442 includes two openings 452, 454, one each disposed adjacent to either the right or left sides.

To assemble the second sized module 104, the back side of the second sized module bus planar member 441 is inserted between the mounting bosses 426, 428 and the second sized module housing planar member lower side 352. The second sized module bus planar member 441 is then brought into face-to-face contact with the second sized module housing planar member lower side 352. As the bus planar member 441 is brought into contact with the second sized module housing planar member lower side 352, each terminal 448, 450 contacts a bus assembly clip angled lower surface 174 causing the clip stem 172 to flex and allow the terminals 448, 450 to pass. Once the second sized module bus planar member 441 is generally parallel to the second sized module planar member lower side 352, the clip stem 172 will return to its original position. At this point, the clip latching surface 173 is located below, and parallel to, the second sized module bus terminals 448, 450. The second sized module bus planar member 441 is secured to the second sized module housing assembly 330 by positioning a collar assembly 190 over the upper side of one of the second sized module housing planar member openings 340, 342 and passing, from the lower side, the collar assembly mounting device 194 through a corresponding second sized module bus planar member opening 454, 456 and the second sized module planar member openings 340, 342 to engage the collar assembly bottom surface 200 threaded opening. Thus, the second sized module bus assembly 440 is coupled to the second sized module housing assembly 330 with the terminals 448, 450 extending beyond the second sized module left and right extension front side walls 362, 364

As shown in FIGS. 9A–9G, the third sized module 106 also includes a housing assembly 500 and a bus assembly 640. The third sized module housing assembly 500 is made from a non-conductive material. The third sized module housing assembly 500 includes a U-shaped, generally planar member 502 having a base portion 504, a left extension 506 and a right extension 508. The third sized module housing planar member 502 has an upper side 510 and a lower side 512. There are two opening 514, 516 extending through the third sized module housing planar member 502. The third sized module housing planar member first opening 514 is disposed adjacent to the third sized module housing assembly base portion 504 left side. The third sized module housing planar member second opening 516 is disposed adjacent to the third sized module housing assembly base portion 504 right side. A plurality of side walls 520 extend upwards from the perimeter of the third sized module housing planar member upper side 510 and downward from the third sized module housing planar member lower side 512. The side walls 520 have, generally, either a uniform height or depth. The height of the third sized module housing upper side walls is between about ½ to 2.0 inches and preferably about 1.0 inch. The depth of the third sized module housing lower side walls is between about ⅛ to 1⅝ inches and preferably about ⅝ inches.

Figure 9A:
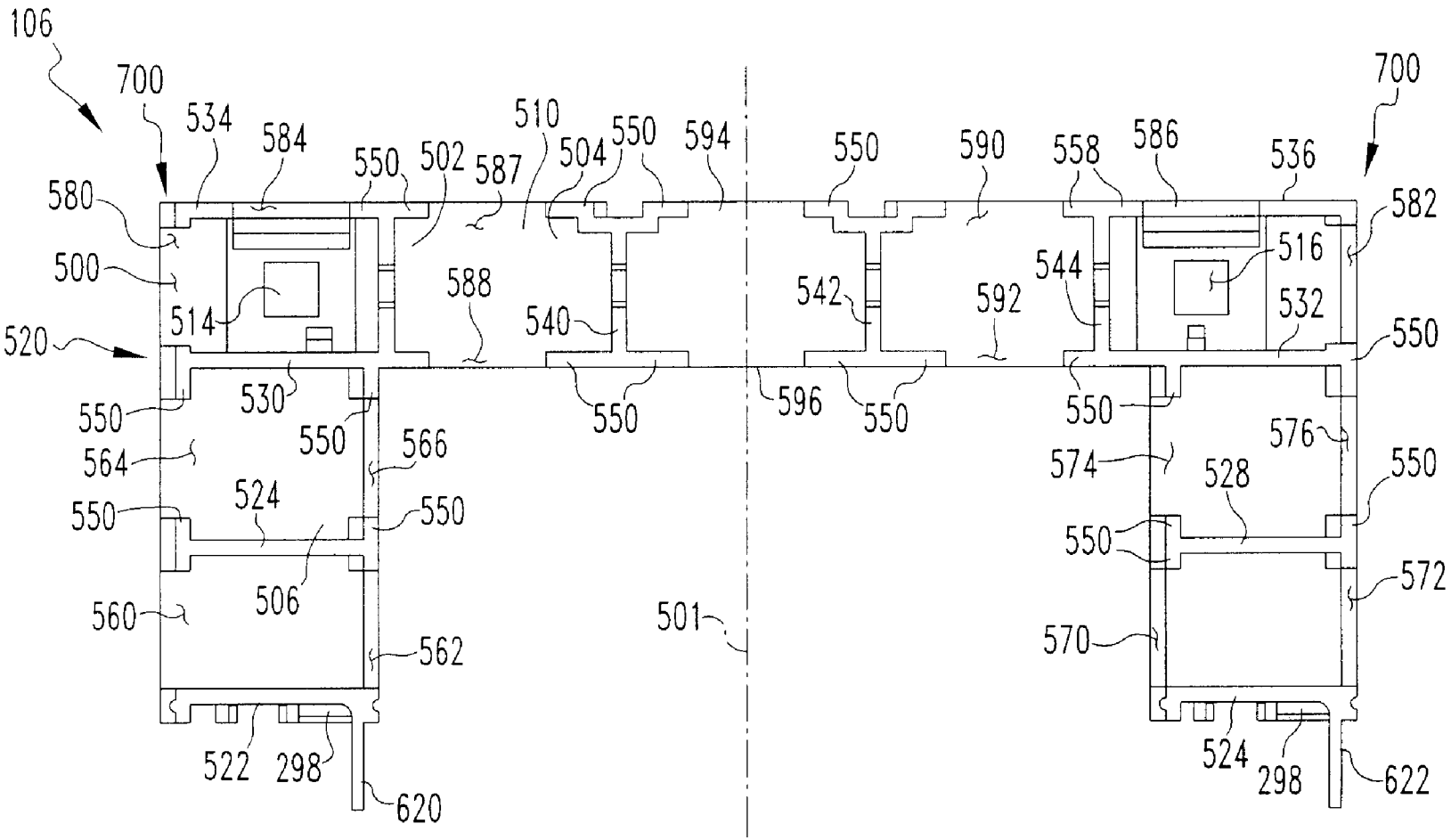
FIG. 9A is a top view of the third sized module.
Figure 9B:
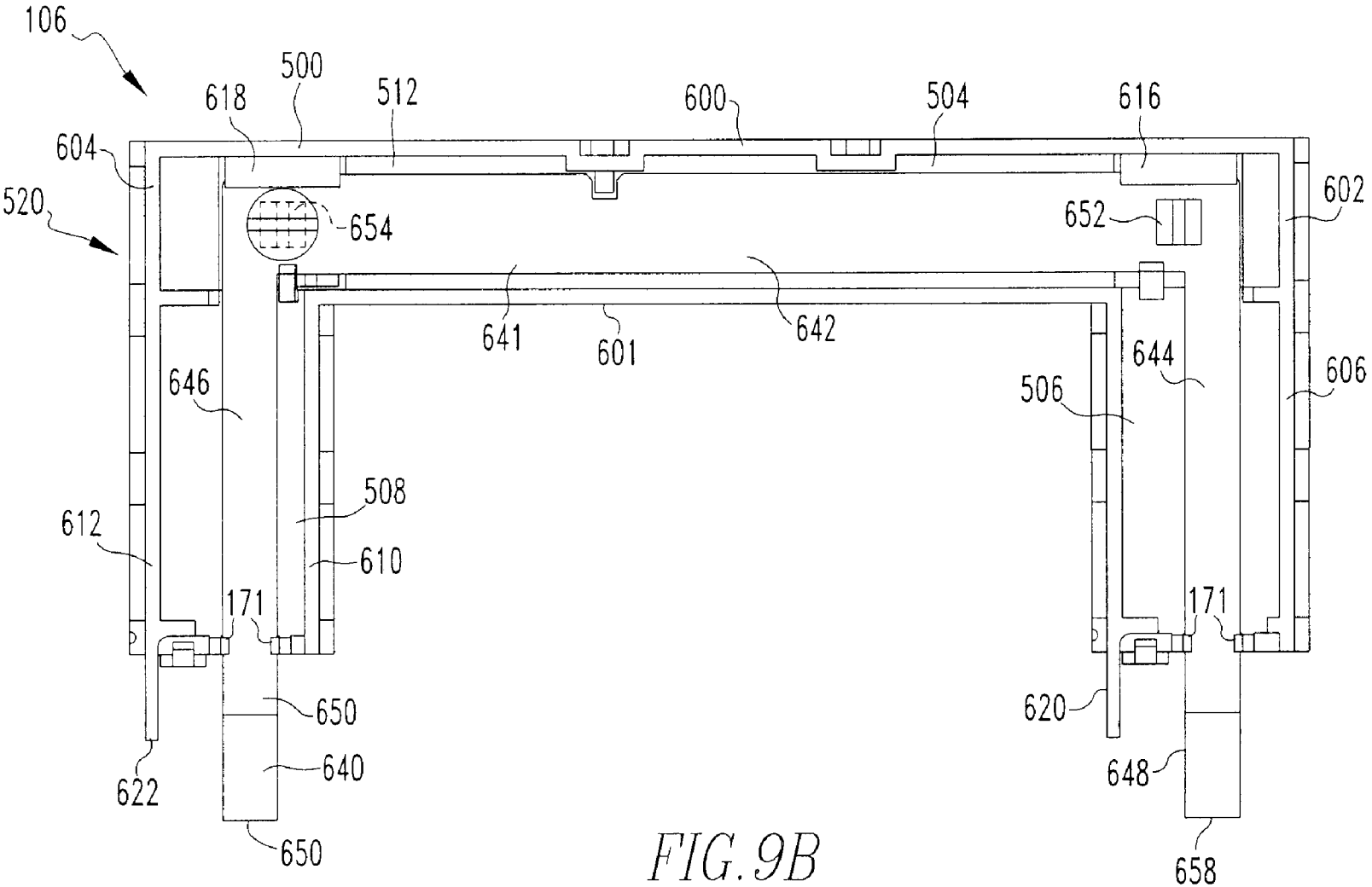
FIG. 9B is a bottom view of the third sized module.
Figure 9C:
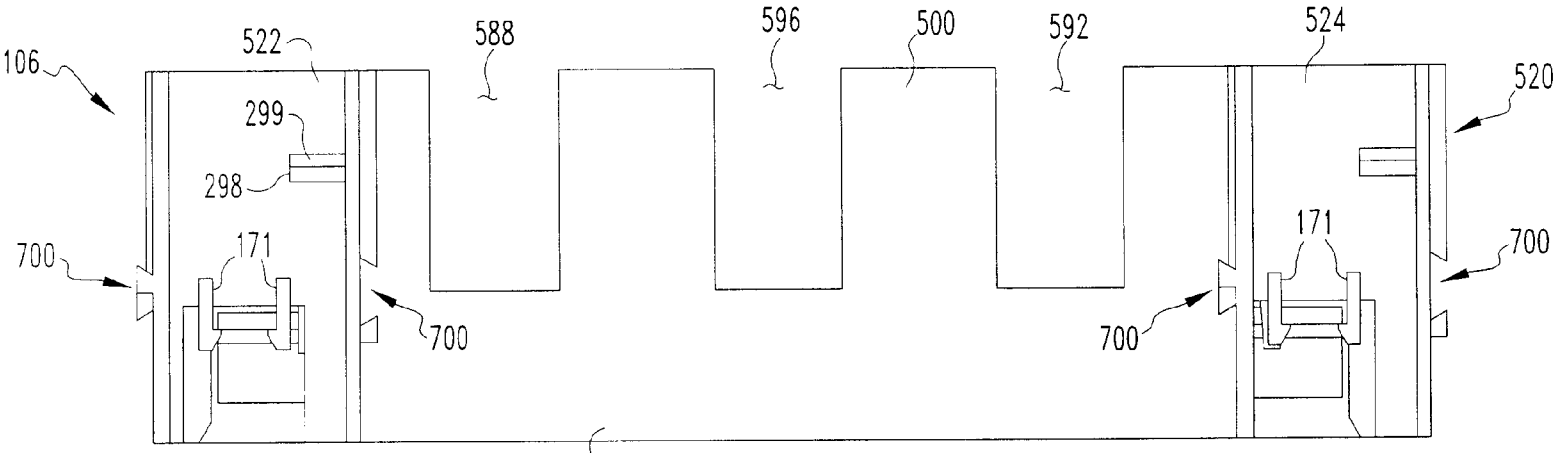
FIG. 9C is a front view of the third sized module.
Figure 9D:
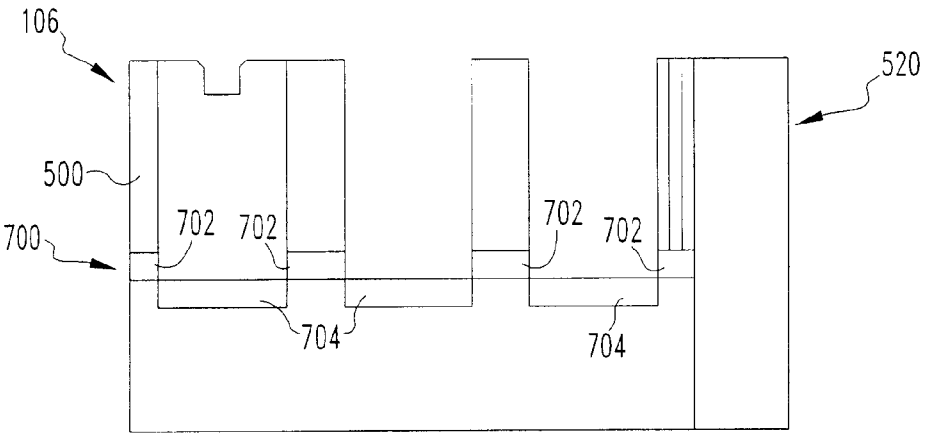
FIG. 9D is a left side view of the third sized module.

As shown best in FIG. 9A, the third sized module housing upper walls include a third sized module left side extension upper front side wall 522, a third sized module right side extension upper front side wall 524, a third sized module left side extension upper front medial side wall 526, a third sized module right side extension upper front medial side wall 528, a third sized module left side extension upper back medial side wall 530, a third sized module right side extension upper back medial side wall 532, a third sized module base portion upper back left side wall 534, and a third sized module base portion upper back right side wall 536. The third sized module upper walls further include four base portion upper side walls 538, 540, 542, 544 which extend front to back. A third sized module base portion upper left outer side wall 538 is disposed adjacent to the right side of the third sized module left extension 506. A third sized module base portion upper left inner side wall 540 is disposed on a generally medial line between the third sized module base portion upper left outer side wall 538 and the third sized module centerline 501. A third sized module base portion upper right outer side wall 544 is disposed adjacent to the right side of the third sized module housing planar member right extension 508. A third sized module base portion upper right inner side wall 542 is disposed on a generally medial line between the third sized module base portion upper right outer side wall 544 and the third sized module centerline 501. As with the first sized module housing side walls 140 and the second sized module side walls 360, the third sized module upper side walls may include tabs 550 which extend generally perpendicularly to selected third sized module upper side walls. The tabs 550 extend front to back at the left and right ends of the third sized module left side extension upper front medial side wall 526, the third sized module right side extension upper front medial side wall 528, the third sized module left side extension upper back medial side wall 530, and the third sized module right side extension upper back medial side wall 532. Additionally, tabs 550 also extend left-to-right at the front and back ends of the four base portion upper side walls 538, 540, 542, 544. The tab 550 on the front side of the third sized module base portion upper left outer side wall 538 extends leftward to become contiguous with third sized module left side extension upper back medial side wall 530. The tab 550 on the front side of the third sized module base portion upper right outer side wall 544 extends rightward to become contiguous with third sized module right side extension upper back medial side wall 532.

Thus, the third sized module upper side walls define a plurality of openings. On the third sized module housing planar member left extension 506 there is an upper front left side opening 560, an upper front right side opening 562, an upper back left side opening 564, and an upper back right side opening 566. On the third sized module housing planar member right extension 508 there is an upper front left side opening 570, an upper front right side opening 572, an upper back left side opening 574, and an upper back right side opening 576. On the third sized module housing assembly base portion 504 there is an upper left side opening 580, an upper right side opening 582, an upper back left side opening 584, and an upper back side right opening 586. Adjacent to the upper back left side opening 584 is a back side left medial opening 587. On the front side of the third sized module housing assembly base portion 504, opposite the third sized module base portion upper back side left medial opening 587 is a front side left medial opening 588. Adjacent to the third sized module base portion upper back side right opening 586 is a back side medial right opening 590. On the front side of the third sized module housing assembly base portion 504, opposite the back side medial right opening 590 is a front side right medial opening 592. Also on the third sized module housing assembly base portion 504, at or about the centerline 501, are a back side medial opening 594 and a front side medial opening 596.

Figure 9E:
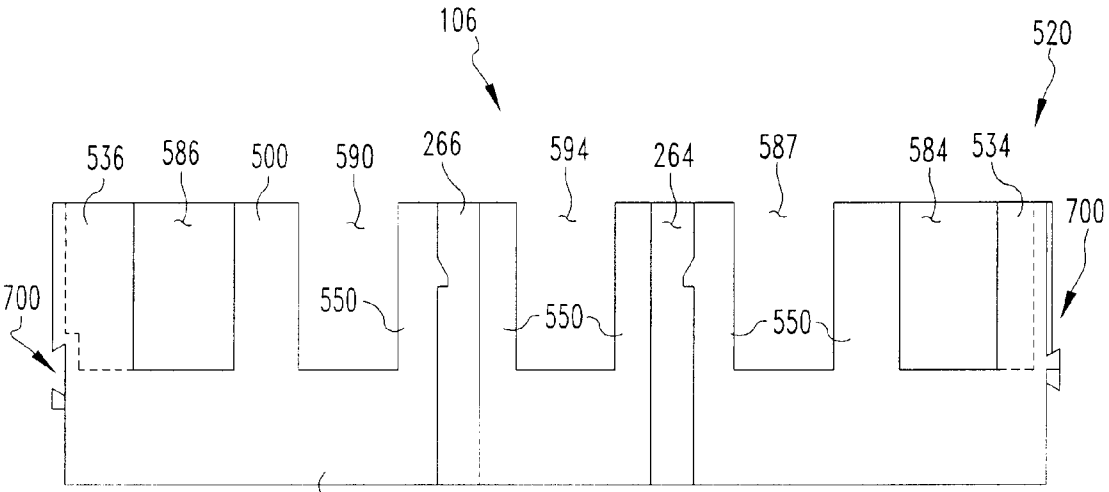
FIG. 9E is a back side view of the third sized module.
Figure 9F:
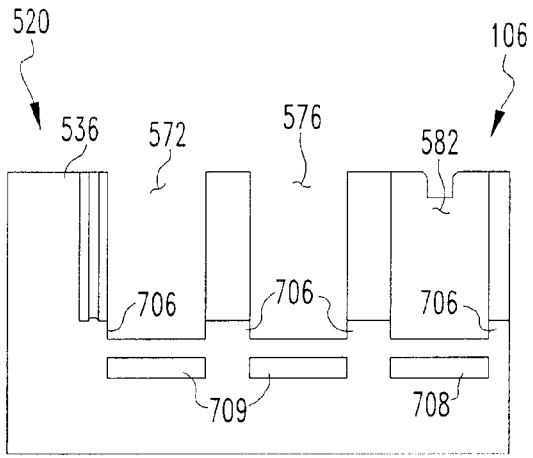
FIG. 9F is a right side view of the third sized module.
Figure 9G:
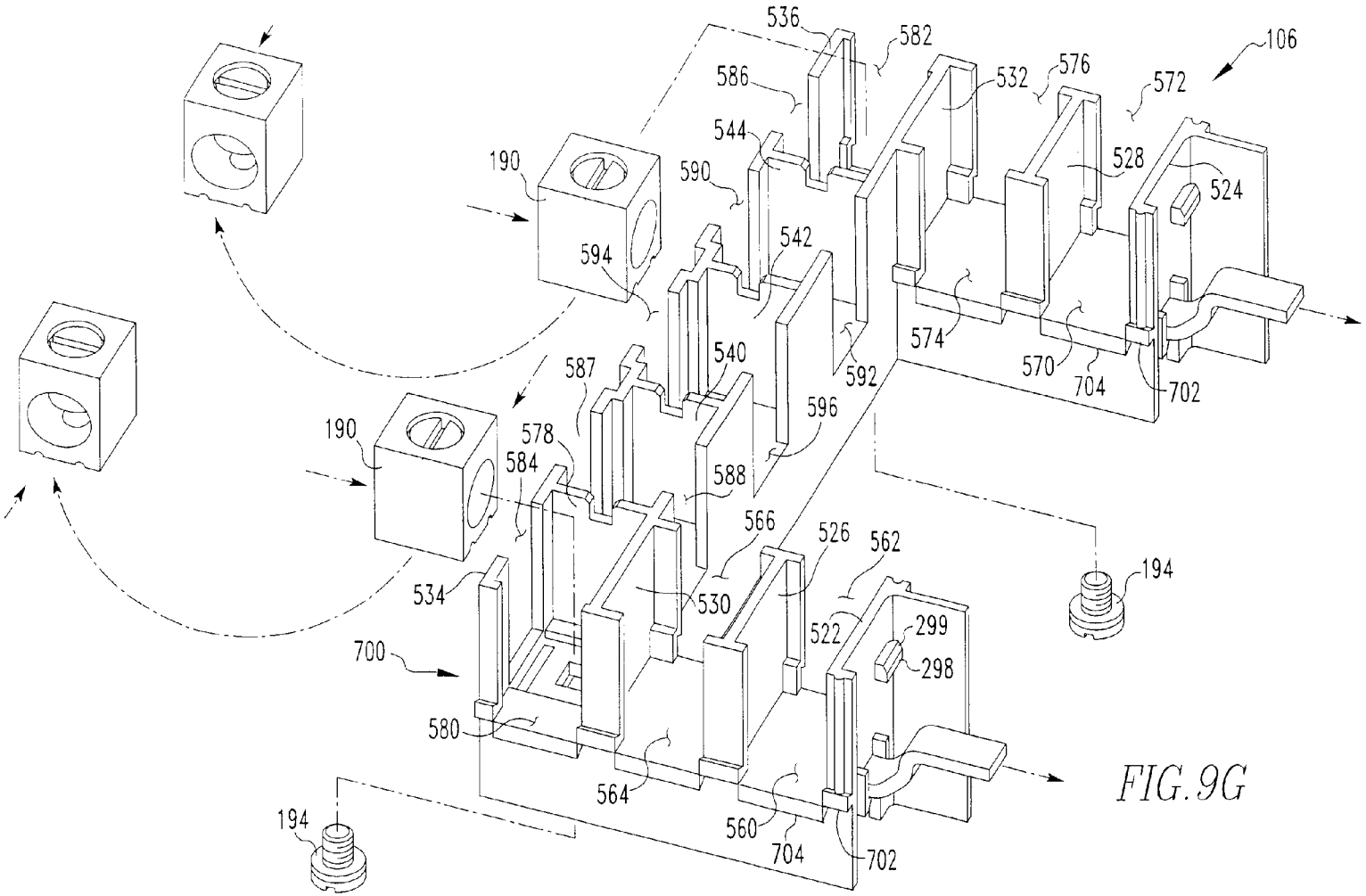
FIG. 9G is an exploded isometric view of the third sized module.

As shown best in FIG. 9G, the third sized module housing lower side walls generally extend along the perimeter of the U-shaped planar member 502, except for the front side of both the left and right extensions 506, 508. Thus, there is a third sized module housing base portion lower back side wall 600, a third sized module housing base portion lower front side wall 601, a third sized module base portion lower left side wall 602, a third sized module base portion lower right side wall 604, a third sized module left extension lower left side wall 606, a third sized module left extension lower right side wall 608, a third sized module right extension lower left side wall 610, and a third sized module right extension lower right side wall 612. The third sized module lower side walls, therefore, defined a third sized module lower raceway 614. As with the second sized module 104, the front side of both the left and right extensions 506, 508 each include one or more bus assembly clips 171 used to secure the third sized module bus assembly 640. Additionally, there are two bus assembly mounting bosses 616, 618 located on the front face of the third sized module housing base portion lower back side wall 600. The third sized module bus assembly mounting bosses 616, 618 are substantially similar to the first sized module bus assembly mounting bus 175.

There are two third sized module front spacers 620, 622. One spacer 620 extends forward from the right side of the third sized module left extension upper front side wall 522 and is an extension of the third sized module left extension lower right side wall 608. The other spacer 622 extends from the right side of the right extension upper front side wall 524 and is an extension of the third sized module right extension lower right side wall 612. The third sized module spacers 620, 622 run vertically and protrude from the third sized module front side walls 522, 524 less distance than the third sized module bus terminals 648, 650 (described below).

The third sized module bus assembly 640 includes a generally U-shaped planar member 641 having a base portion 642, a left extension 644, and a right extension 646. The third sized module bus planar member left and right extensions 644, 646 end in two terminals 648, and 650. The two terminals 648, 650 each have a planar distal end 656, 658. The terminals 648, 650 may have a bent portion 660 that shifts the planar distal ends 656, 658 out of the plane of the third sized module bus planar member 641. The third sized module bus assembly 640 further includes one or more collar assemblies 190. The third sized module bus planar member base portion 642 includes two openings 652, 654, one each disposed adjacent to either the right or left sides.

To assemble the third sized module 106, the back side of the third sized module bus planar member 641 is inserted between the third sized module bus assembly mounting bosses 616, 618 and the third sized module housing planar member lower side 512. The third sized module bus planar member 641 is then brought into face-to-face contact with the third sized module housing planar member lower side 512. As the third sized module bus planar member 641 is brought into contact with the third sized module planar member lower side 512, each terminal 648, 650 contacts a bus assembly clip angled lower surface 174 causing the clip stem 172 to flex and allow the terminals 648, 650 to pass. Once the third sized module bus planar member 641 is generally parallel to the third sized module housing planar member 502, the clip stem 172 will return to its original position. At this point, the clip latching surface 173 is located below, and parallel to, each third sized module housing bus terminal 648, 650. The third sized module bus planar member 541 is secured to the third sized module housing assembly 500 by positioning a collar assembly 190 over one of the third sized module housing planar member openings 514, 516 while passing, from the lower side, the collar assembly mounting device 194 through a corresponding third sized module bus planar member opening 652, 654 and the third sized module planar member openings 516, 518 to engage the collar assembly bottom surface 200 threaded opening. Thus, the third sized module bus assembly 640 is coupled to the third sized module housing assembly 500 with the terminals 648, 650 extending beyond the third sized module left and right extension front side walls 522, 524.

Figure 12A:
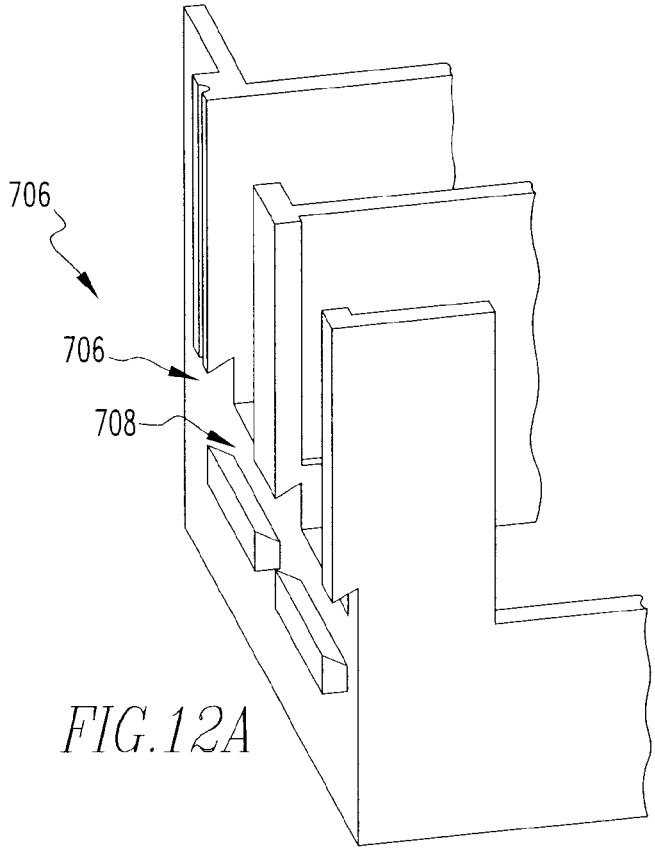
FIG. 12 is an isometric view of the tongue-and-groove connector.
Figure 12B:
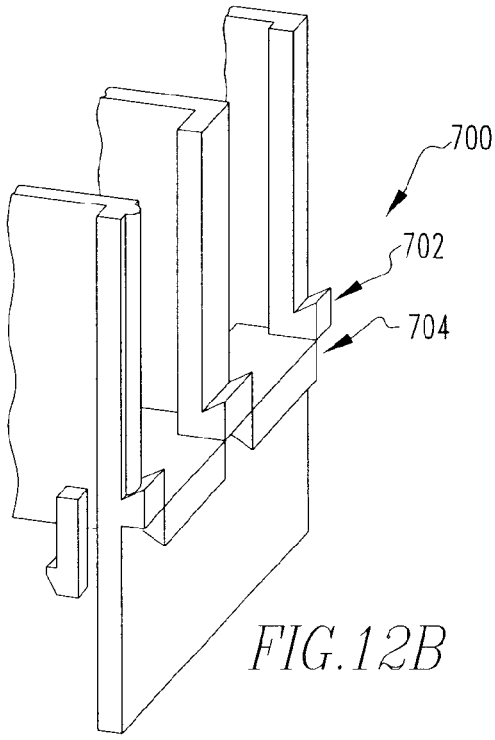

The first sized module 102, the second sized module 104 and the third sized module 106 are coupled together by a plurality of bisected tongue-and-groove connectors 700. As shown on FIG. 12, the bisected tongue-and-groove connectors 700 include an upper tongue portion 702, a lower tongue portion 704, an upper groove portion 706 and a lower groove portion 708. Each of the upper tongue portion 702, lower tongue portion 704, upper groove portion 706 and lower groove portion 708 extend in a horizontal direction beyond the side walls 140, 360, 520 of the first sized module 102, second sized module 104, and third sized module 106. As shown in FIGS. 7A, 7G, 8A, 8G, 9A and 9G, generally, the tongue-and-groove connectors 700 are disposed adjacent to the left and right openings 152, 154, 390, 392, 394, 396, 398, 400, 560, 562, 564, 566, 570, 572, 574, 576, 580, 582. More specifically, each upper tongue portion 702 and lower tongue portion 704 is disposed to the left side of one of the left openings 152, 390, 394, 398, 560, 564, 570, 574, 580. Each upper tongue portion 702 is disposed on an upper left side wall. Each lower tongue portion 704 is disposed on a lower side wall below a left opening 152, 390, 394, 398, 560, 564, 570, 574, 580. Additionally, each lower tongue portion 704 has an upper surface 705. The lower tongue upper surface 705 is contiguous with, and in the same plane as, either the first sized module housing planar member upper side 136, the second sized module housing planar member upper side 350, or the third sized module housing planar member upper side 510. Each upper groove portion 706 and lower groove portion 708 is disposed to the right of one of the right openings 154, 392, 396, 400, 562, 566, 572, 576, 582. Each upper groove portion 706 is disposed on a right upper side wall. Each lower groove portion 708 is disposed on a right lower side wall below a right side opening 154, 392, 396, 400, 562, 566, 572, 576, 582.

Figure 19:
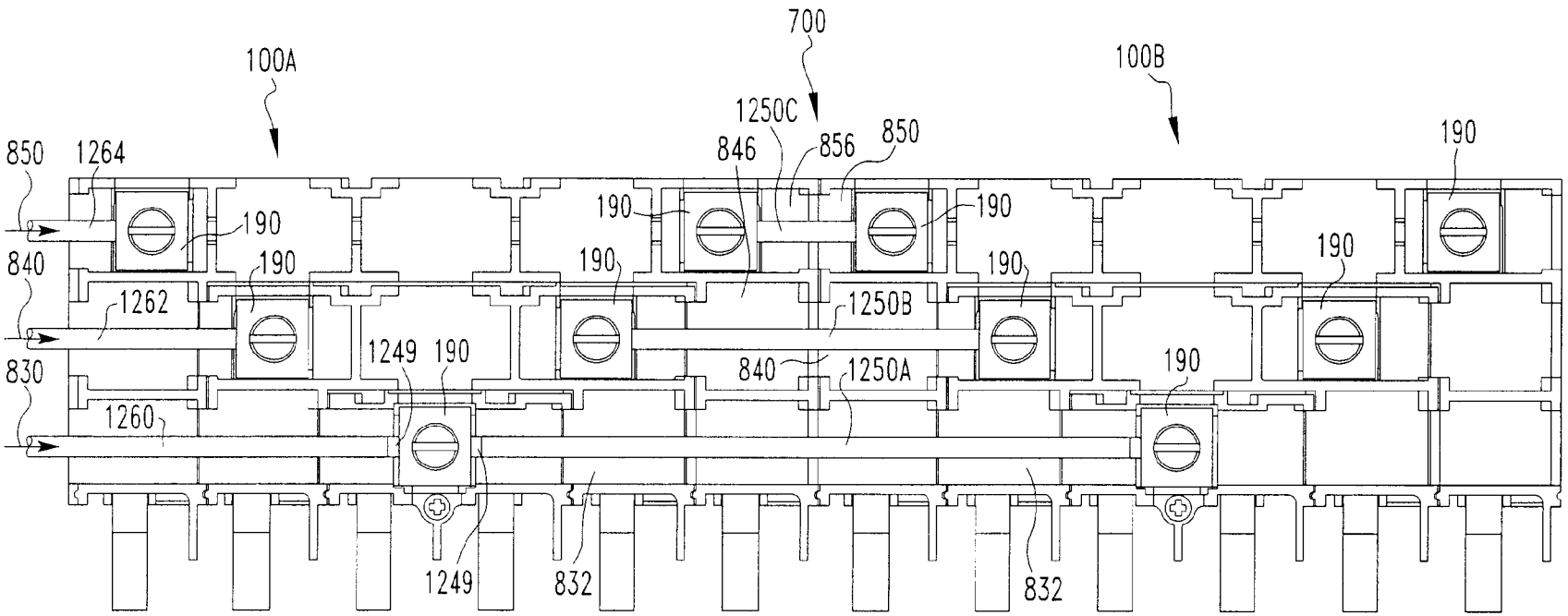
FIG. 19 is a top view of linked jumper assemblies.

When the first sized module 102, second sized module 104, and third sized module 106 are assembled into the modular jumper assembly 100, each upper tongue portion 702, except those tongue portions on the left side and the groove portions on the right side of the third sized module 106, will engage a corresponding upper groove portion 706 on an adjacent module 102, 104, 106. Additionally, because the third sized module 106 includes tongue-and-groove connectors 700 on the outer left and right sides, two or more modular jumper assemblies 100 may be joined together as shown in FIG. 19, this multi-jumper assembly configuration 1248 is discussed further below. Additionally, when the modular jumper assembly 100 is assembled, each bus assembly 180, 440, 640 are generally co-planar, and the housing planar members 132, 332, 502 are generally co-planar.

Figure 2:
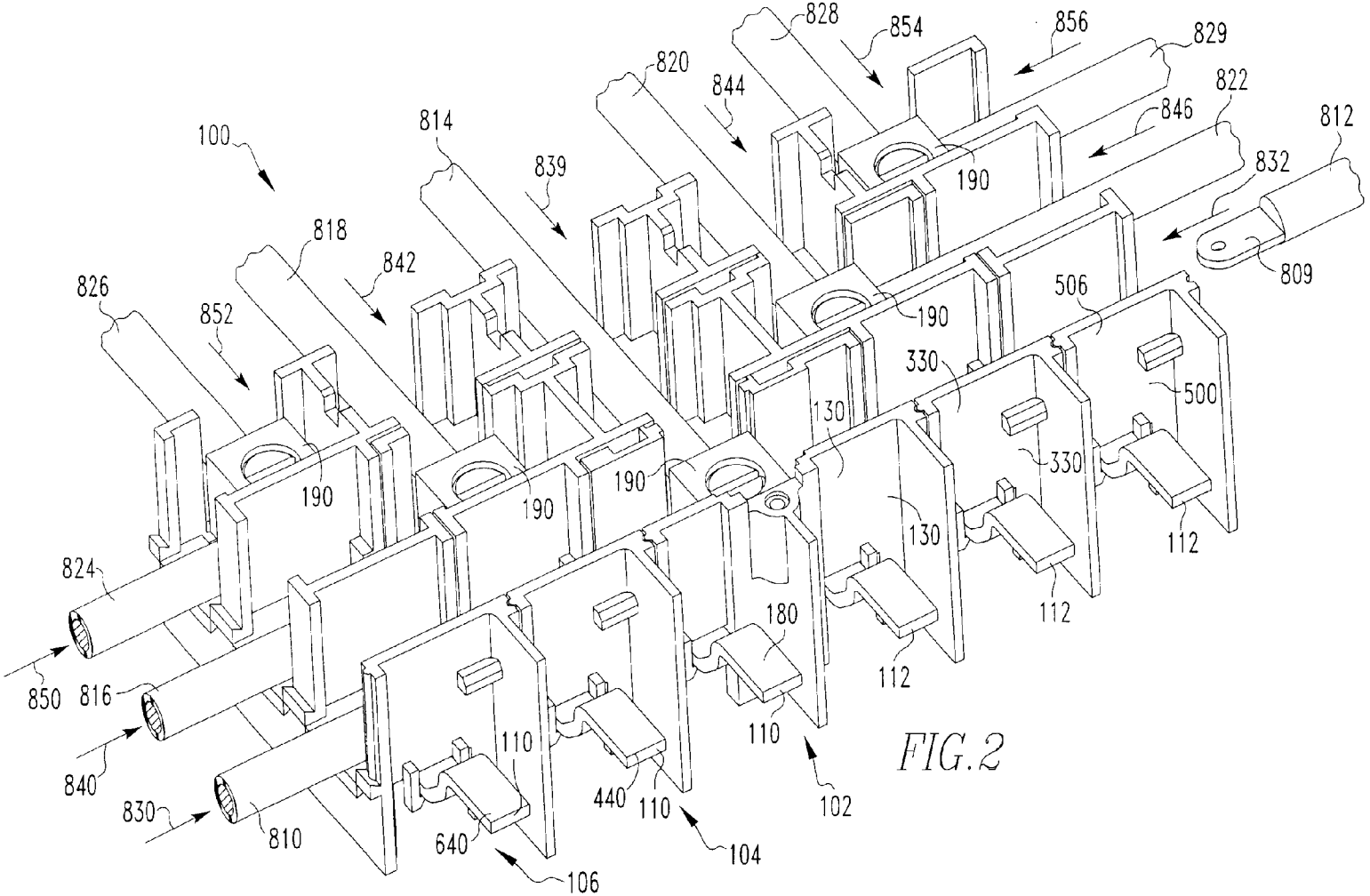
FIG. 2 is an isometric view of the modular jumper assembly.
Figure 4:
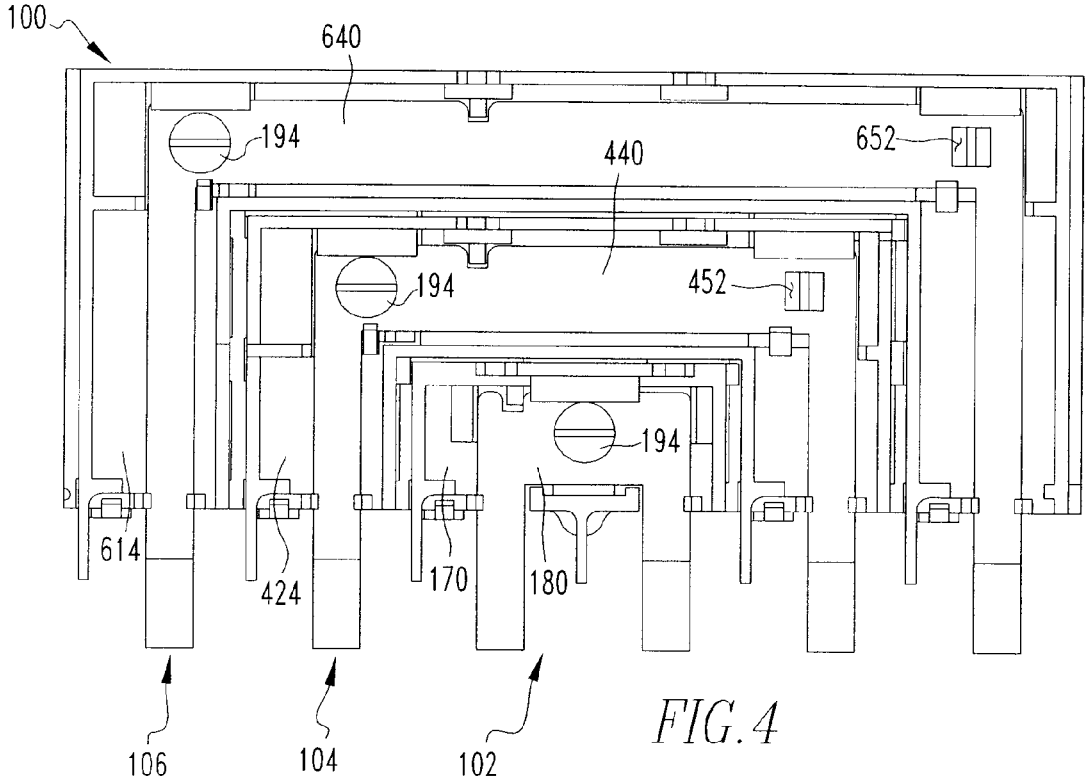
FIG. 4 is a bottom plan view of the modular jumper assembly.
Figure 5:
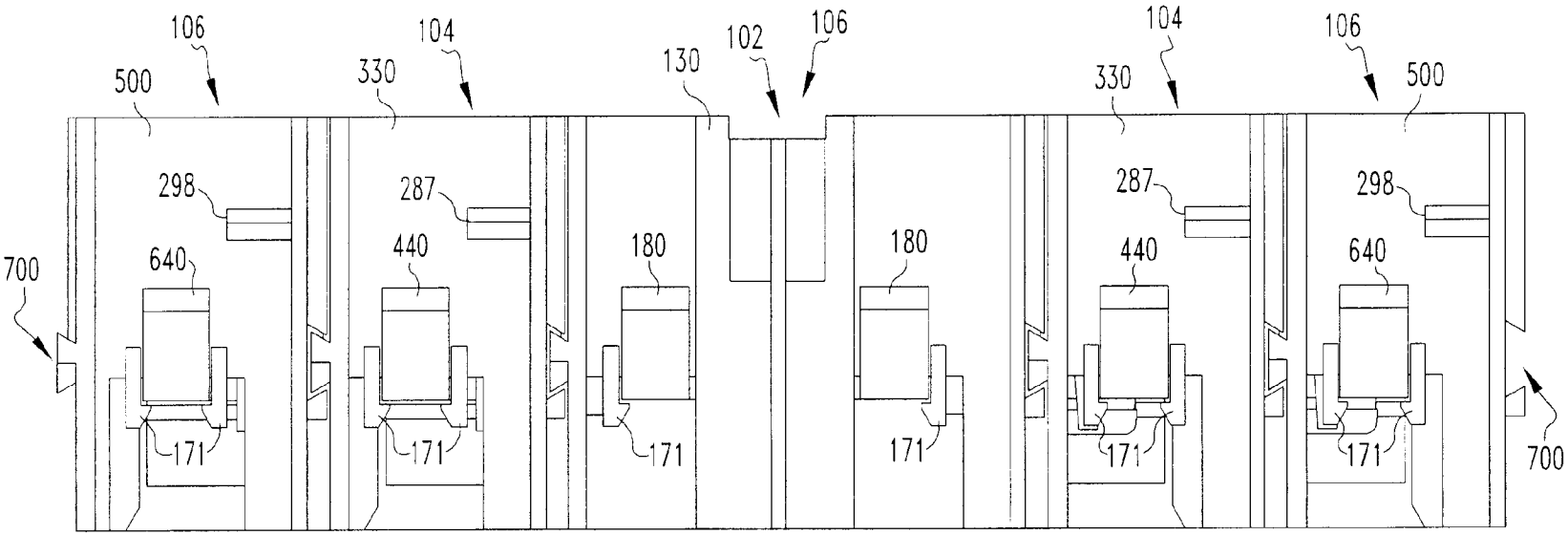
FIG. 5 is a front elevational view of the modular jumper assembly.

The lower side raceways 170, 424, 614 are shown clearly on FIG. 4. As discussed above, the lower side raceways 170, 424, 614 have the same general shape as the first, second, and third sized module housing planar members 132, 332, 502. In addition to the lower raceways 170, 424, 614, the modular jumper assembly 100 includes a plurality of upper raceways 800, as shown in FIGS. 2 and 3. The plurality of upper raceways 800 are only formed when two or more modules 102, 104, 106 are joined together to form the modular jumper assembly 100. The plurality of upper raceways 800 provide a path for one or more power lines 810, 812, 814, 816, 818, 820, 822, 824, 826, 828, 829 to access and be coupled to the collar assemblies 190 attached to the first sized module bus assembly 180, the second sized module bus assembly 440, and the third sized module bus assembly 640. Each upper race way 800 is separated from an adjacent upper raceway 800 by one or more upper side walls.

For example, there are three upper first sized module upper raceways 830, 832, 834 to access the first sized module collar assembly 190 coupled to the first sized module bus assembly. Each first sized module upper raceway 830, 832, 834 extends across all three modules 102, 104, 106. That is, there is a first sized module upper left raceway 830, a first sized module upper right raceway 832, and a first sized module upper medial raceway 834. The first sized module upper left raceway 830 provides a path extending left to right, from the left side of the modular jumper assembly 100 to the center of the first sized module 102. The first sized module upper left raceway 830 is formed by the third sized module left extension upper front left side opening 560, the third sized module left extension upper front right side opening 562, the second sized module left extension upper left side opening 390, the second sized module left extension upper right side opening 392, and the first sized module upper left side opening 152. The first sized module upper right raceway 832 is formed by the third sized module right extension upper front right side opening 572, the third sized module right extension upper front left side opening 570, the second sized module right extension upper right side opening 396, the second sized module right extension upper left side opening 394, and the first sized module upper right side opening 154. The first sized module upper medial raceway 834 is formed by the third sized module base portion upper back side medial opening 594, the third sized module base portion upper front side medial opening 596, the second sized module base portion upper back side medial opening 406, the second sized module base portion upper front side medial opening 408, and the first sized module upper back side medial opening 148. Accordingly, there may be a first sized module left side power line 810, shown in ghost, extending through the first sized module upper left raceway 830 and coupled to the collar assembly 190 disposed above the first sized module bus planar member medial opening 183, a first sized module right side power line 812 extending through the first sized module upper right raceway 832 and coupled to the collar assembly 190 disposed above the first sized module bus planar member medial opening 183, and/or a first sized module medial power line 814 extending through the first sized module upper medial raceway 834 and coupled to the collar assembly 190 disposed above the first sized module bus planar member medial opening 183.

When single power line, for example the left side power line 810, is used, the power line 810 is passed through a collar assembly side opening 204 and secured with the collar fastening device 196. If two or more power lines 810, 812, 814 coupled to the collar assembly 190 disposed above the first sized module bus planar member medial opening 183, a flat power line terminal end 809 may be used so as to provide sufficient space within the collar assembly 190.

There are four second sized module upper raceways 840, 842, 844, 846. More specifically, there is a second sized module upper left raceway 840, a second sized module upper back side left raceway 842, a second sized module upper back side right raceway 844, and a second sized module upper right raceway 846. The second sized module left raceway 840 is formed by the third sized module left extension upper back left side opening 564, third sized module left extension upper back right side opening 566, and the second sized module base portion upper left side opening 398. The second sized module upper back side left raceway 842 is formed by the third sized module base portion upper back side left medial opening 587, the third sized module base portion upper front side left medial opening 588 and the second sized module base portion upper back side left opening 402. The second sized module upper back side right raceway 844 is formed by the third sized module base portion upper back side right medial opening 590, the third sized module base portion upper front side right medial opening 592 and the second sized module base upper portion back side right opening 404. The second sized module right raceway 846 is formed by the third sized module right extension upper back right side opening 576, third sized module right extension upper back left side opening 574, and the second sized module base portion upper right side opening 400. Accordingly, there may be a second sized module left power line 816 extending through the second sized module left raceway 840, and/or a second sized module left back power line 818 extending through the second sized module left back raceway 842, coupled to the collar assembly 190 disposed above the second sized module planar member first opening 340. Additionally, there may be a second sized module right power line 822 extending through the second sized module right raceway 846, and/or a second sized module right back power line 820 extending through the second sized module upper back side right raceway 844, coupled to the collar assembly 190 disposed above the second sized module planar member second opening 342.

There are four third sized module upper raceways 850, 852, 854, 856. More specifically, there is a third sized module upper left raceway 850, a third sized module upper back left raceway 852, a third sized module upper back right raceway 854, and a third sized module upper right raceway 856. The third sized module upper left raceway 850 is formed by the third sized module base portion upper left side opening 580. The third sized module back left raceway 852 is formed by the third sized module base portion upper back left side opening 584. The third sized module upper back right raceway 854 is formed by the third sized module base portion upper back right side opening 586. The third sized module upper right raceway 856 is formed by the third sized module base portion upper right side opening 582. Accordingly, there may be a third sized module left power line 824 extending through the third sized module left raceway 850, and/or a third sized module left back power line 826 extending through the third sized module left back raceway 852, coupled to the collar assembly 190 disposed above the third sized module planar member first opening 514. Additionally, there may be a third sized module right power line 829 extending through the third sized module right raceway 856, and/or a third sized module right back power line 828 extending through the third sized module right back raceway 854, coupled to the collar assembly 190 disposed above the third sized module planar member second opening 516.

Figure 13:
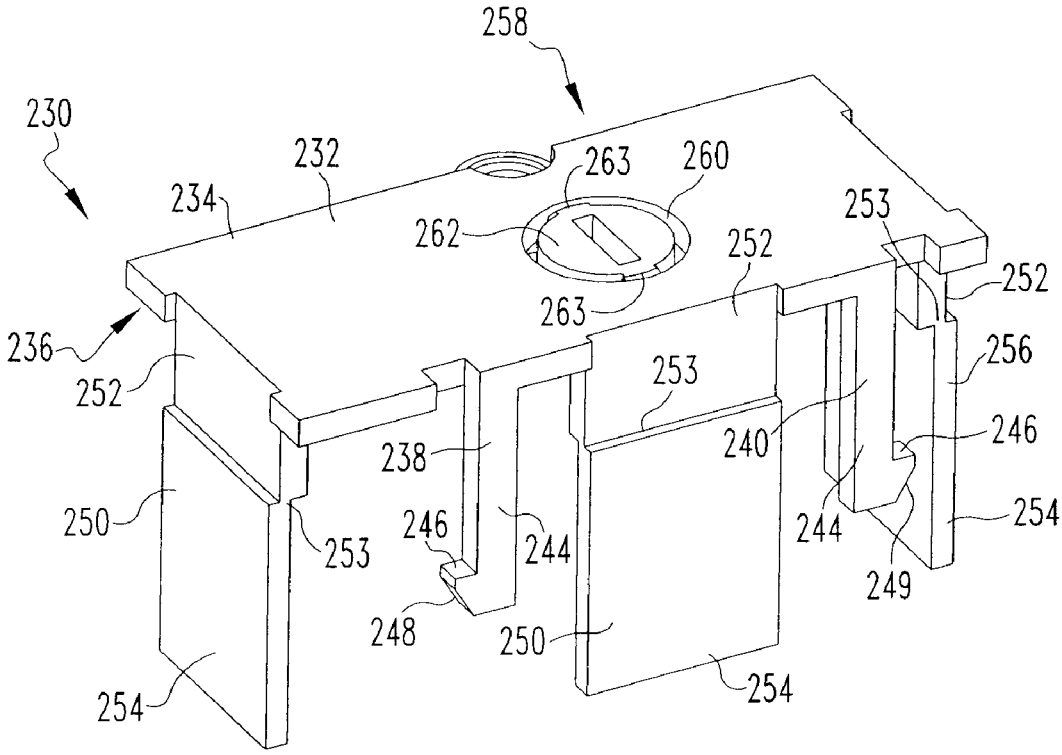
FIG. 13 is an isometric view of the first sized module cover assembly.
Figure 14A:
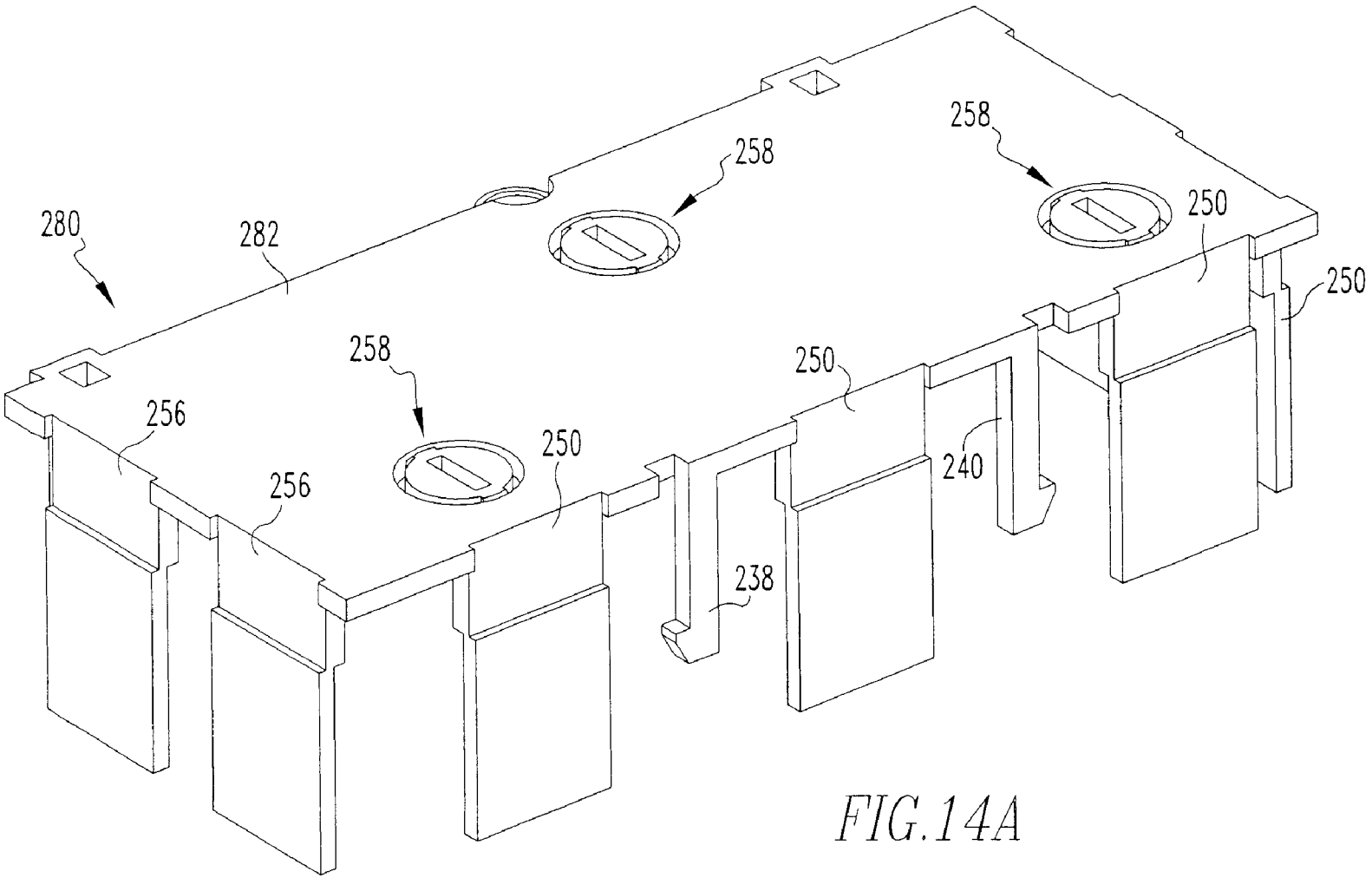
FIG. 14A is an isometric view of the back side of the second sized module cover assembly.
Figure 14B:
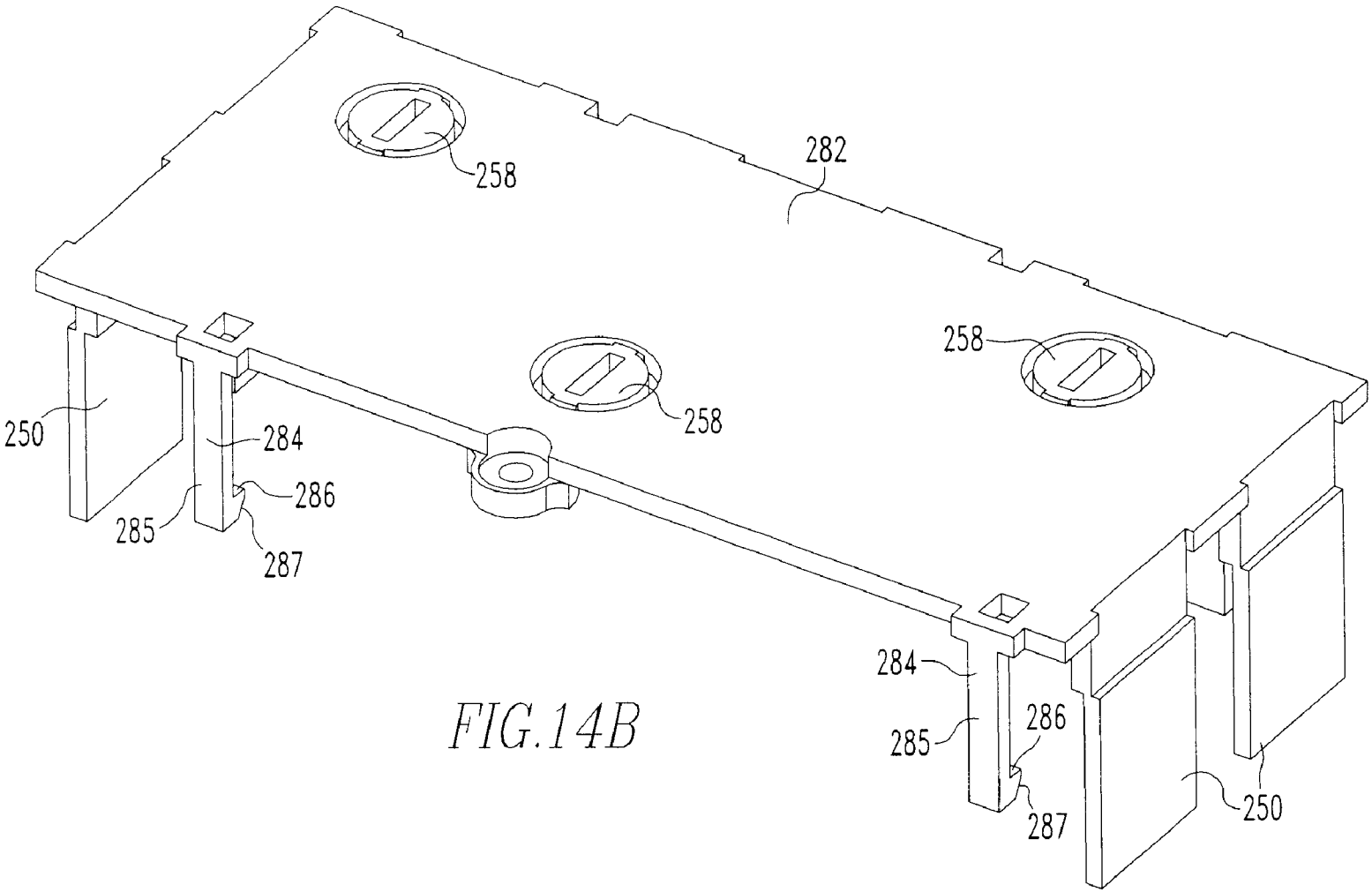
FIG. 14B is an isometric view of the front side of the second sized module cover assembly.
Figure 15:
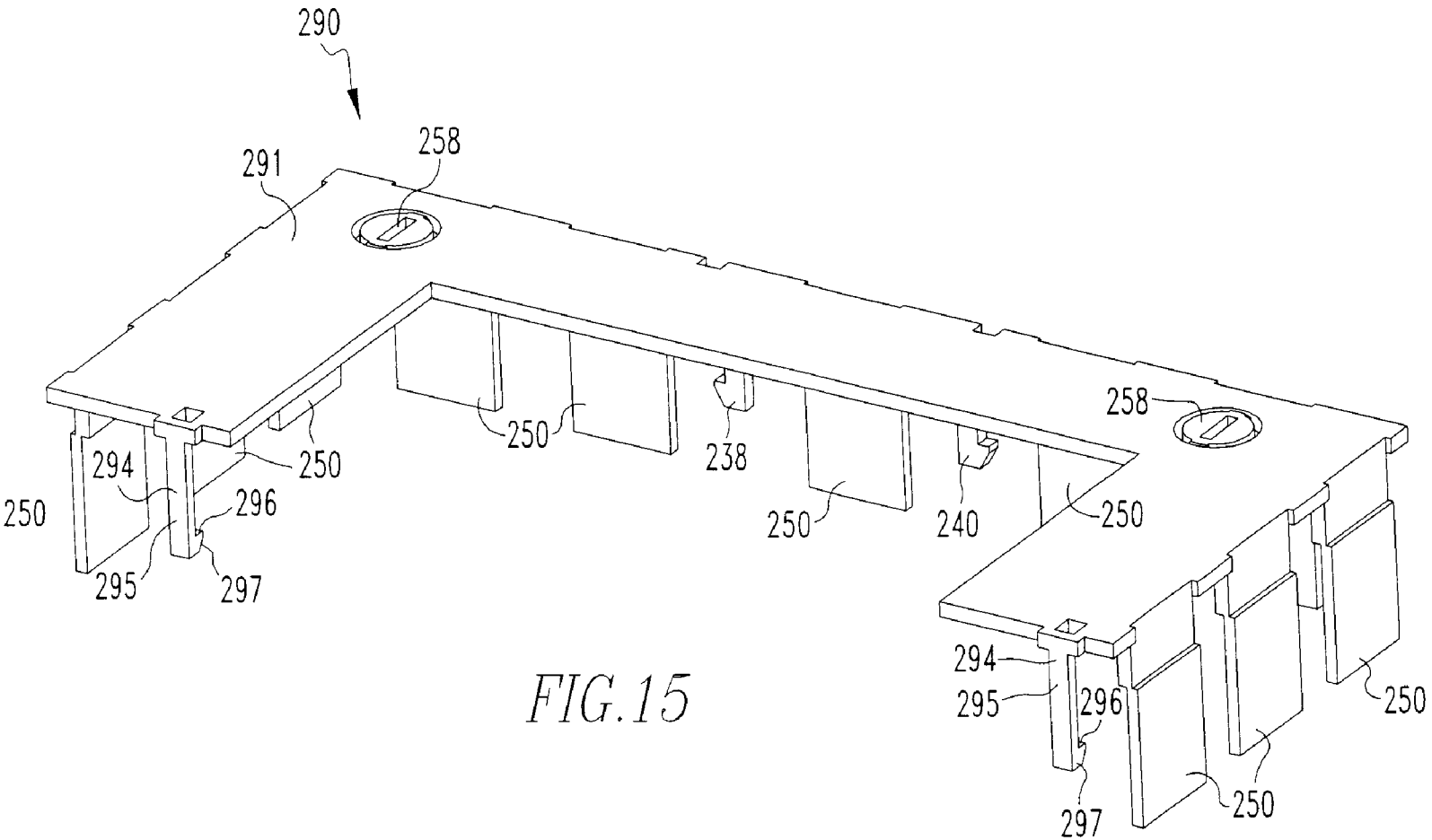
FIG. 15 is an isometric view of the third sized module cover assembly.

As shown in FIGS. 13–15, the modular jumper assembly 100 also includes a snap-fit cover assembly 230, 280, 290. The cover assembly 230, 280, 290 is sized to fit the largest module 102, 104, 106 used to create the modular jumper assembly 100. For example, the first sized module cover assembly 230, shown in FIG. 13, is structured to fit a modular jumper assembly 100 formed from a single first sized module 102. The first sized module cover assembly 230 includes a planar member 232 having an upper side 234 and a lower side 236. One or more latching members 238, 240 extend downwardly from the first sized module cover planar member 232 back side. Each latching members 238, 240 include an elongated flexible stem 244, a perpendicular latching surface 246, and an angled lower surface 248. The first sized module cover assembly 230 also includes a plurality of raceway covers 250. Each raceway cover 250 includes a base portion 252, which extends downwardly from the first sized module cover planar member 232, and a break-away portion 254 coupled to the base portion 252 by a frangible seam 253. The raceway covers 250 are positioned to be disposed in the upper, outer openings on a housing assembly. Thus, the first sized module cover assembly 230 includes three raceway covers 250 that are structured to fit with the first sized module left opening 152, the first sized module back medial opening 148 and the first sized module right opening 154. The break-away portion 254 of the raceway cover 250 may be removed by fracturing the coupling between the raceway cover base portion 252 and the break-away portion 254. The break-away portion 254 is removed at the raceway where the power line(s), e.g. first sized module power line 810, will be disposed.

The first sized module cover assembly planar member 232 also includes a knockout access assembly 258. The knockout access assembly 258 is a removable portion of the first sized module cover assembly planar member 232. The knockout access assembly 258 includes a generally circular opening 260 in the first sized module cover assembly planar member 232 and a removable member 262 sized to fit within the opening 260 and attached to the first sized module cover assembly planar member 232 by frangible tabs 263. The opening 260 in the cover assembly planar member is positioned so as to be located over the collar assembly fastening device 196 when the cover assembly 230 is coupled to the first sized module housing assembly.

The cover assembly latching members 238, 240 are structured to cooperate with latch channels 264, 266 disposed on back side of each module 102, (FIG. 7E) 104 (FIG. 8E), 106 (FIG. 9E). Again with reference to the first sized module 102, the latch channels 264, 266 are disposed on the back side of the first sized module upper left back side wall 144 and the first sized module upper right back side wall 146. The latch channels 264, 266 include a latch protuberance 268 extending into the channel 264, 266. The latch protuberance 268 includes an angled upper surface 270 and a latch surface 271. The protuberance latch surface 271 extends generally perpendicular to the latch channel 264, 266 side wall, that is, in a generally horizontal direction.

To install the first sized module cover assembly 230, an operator initially removes the raceway break-away portion 254 that would be disposed in the first sized module upper opening where the power line, 810 e.g. is disposed. The first sized module cover assembly 230 is then placed over the top of the first sized module 102 with the latching members 238, 240 disposed in the top portion of the latch channels 264, 266. The operator then pushes the first sized module cover assembly 230 towards the first sized module housing planar member 132. As the latching member angled lower surface 248 contacts the latch protuberance angled upper surface 270, the latching member flexible stem 244 flexes to allow the latching member perpendicular latching surface 246 to pass the latch protuberance 268. Once the latching member perpendicular latching surface 246 passes the protuberance latch surface 271, the latching member flexible stem 244 snaps back to its original position. At this point, the latching member perpendicular latching surface 246 is adjacent to the protuberance latch surface 271, thereby latching the first sized module cover assembly 230 to the first sized module housing assembly 130. Should the operator need to access the first sized module collar assembly fastening device 196, for example, to remove the power line 810, the operator needs only to remove the first sized module cover assembly knockout access assembly 258.

A second sized module cover assembly 280 is shown in FIGS. 14A and 14B. The second sized module cover assembly 280 includes a planar member 282 sized to fit over top of a combination of the first sized module 102 and the second sized module 104. The second sized module cover assembly 280 also includes one or more latching members 238, 240 extending downwards from the back side of the second sized module cover assembly planar member 282. The second sized module cover assembly 280 also includes a plurality of raceway covers 250. The raceway covers 250 on the second sized module cover assembly 280 are positioned to be disposed within the second sized module left extension upper left side opening 390, the second sized module right extension upper right side opening 396, the second sized module base portion upper left side opening 398, second sized module upper right side opening 400, second sized module upper back side left opening 402, second sized module upper back side right opening 404, and the second sized module upper back side medial opening 406. As shown in FIG. 8E, the latch channels 264, 266 on the second sized module housing assembly 330 are disposed on the back face of the tabs 380 on the back side of the second sized module housing base portion upper left medial side wall 374 and the second sized module housing base portion upper right medial side wall 376. The second sized module cover assembly 280 also may have one or more front side clips 284 each having an elongated flexible stem 285, a perpendicular latching surface 286, and an angled lower surface 287. The second sized module cover assembly front side clips 284 are structured to engage a block shaped front side latch protuberance 287 (FIG. 8G) disposed on the front side of the second sized module housing assembly 330. The second sized module front side latch protuberance 287 may have an angled upper surface 288. Additionally, as with the first sized module cover assembly 230, the second sized module cover assembly 280 includes a knockout access assembly 258 disposed at a location corresponding to each location of a collar assembly 190 that is attached to either the first sized module bus assembly 180 or the second sized module bus assembly 440.

The cover assembly 290 for the third sized module 106 may be a larger version of the second sized module cover assembly 280 having additional knockout access assemblies 258 and raceway covers 250. That is, the third sized module cover assembly may have a rectangular planar member (not shown) having, in addition to the knockout access assemblies 258 at the locations on the second sized module cover assembly 280, knockout access assemblies 258 disposed at a location corresponding to each location of a collar assembly 190 that is attached to the third sized module bus assembly 640. Additionally, the third sized module cover assembly 290 would have raceway covers 250 located at locations corresponding to the third sized module housing assembly left extension upper front left side opening 560 and upper back left side opening 564, the third sized module right extension upper front right side opening 572 and an upper back right side opening 576, the third sized module housing planar member base portion 334 upper left side opening 580, an upper right side opening 582, an upper back left side opening 584, and an upper back side right opening 586, upper back side left medial opening 587, upper back side medial right opening 590, and upper back side medial opening 594.

Alternatively, as shown in FIG. 15, the third sized module cover assembly 290 may be structured to cooperate with the second sized module cover assembly 280. That is, the third sized module cover assembly 290 may have a U-shaped planar member 291 sized to correspond to the third sized module housing assembly 500. The third sized module cover assembly planar member 291 includes knockout access assemblies 258 disposed at a location corresponding to each location of a collar assembly 190 that is attached to the third sized module bus assembly 640. Additionally, the third sized module cover assembly 290 includes a plurality of raceway covers 250 extending downwards from the third sized module cover assembly planar member 291. The third sized module cover assembly raceway covers 250 are located at locations corresponding to the third sized module left extension upper front left side opening 560 and upper back left side opening 564, the third sized module right extension upper front right side opening 572 and an upper back right side opening 576, the third sized module housing planar member base portion 334, upper left side opening 580, an upper right side opening 582, an upper back left side opening 584, and an upper back side right opening 586, upper back side left medial opening 587, upper back side medial right opening 590, and upper back side medial opening 594. The third sized module cover assembly 290 may have one or more front side clips 294 each having an elongated flexible stem 295, a perpendicular latching surface 296, and an angled lower surface 297. The third sized module cover assembly front side clips 294 are structured to engage a block shaped front side latch protuberance 298 (FIG. 9G) disposed on the front side of the third sized module housing assembly 500. The third sized module front side latch protuberance 298 may have an angled upper surface 299.

The third sized module cover assembly 290 also includes one or more latching members 238, 240 extending downwards from the back side of the third sized module cover assembly planar member 291. Like the latching members 238, 240 on the second sized module cover assembly 280, the latching members 238, 240 on the third sized module cover assembly 290 cooperate with latch channels 264, 266 located on the third sized module housing assembly 500. As shown in FIG. 9E, the latch channels 264, 266 on the third sized module housing assembly 500 are disposed on the back face of the tabs 550 on the back side of the third sized module base portion upper left inner side wall 540 and the third sized module base portion upper right inner side wall 542.

In the embodiment described above, the jumper assembly 100 is formed from three modules 102, 104, 106. A first alternate modular jumper assembly 900 is shown in FIGS. 14A–14C. The first alternate jumper assembly 900, hereinafter the fourth sized module, is, essentially, a single module that combines the features of the first sized module 102 and second sized module 104. The fourth sized module includes a housing assembly 902, a first sized module bus assembly 180, and a second sized module bus assembly 440. The fourth sized module is generally symmetric about a centerline 901. The fourth sized module housing assembly 902 includes a planar member 904 having an upper side 906 and a lower side 908. There are three openings 910, 912, 914 extending through the fourth sized module housing planar member 904. The fourth sized module housing planar member first opening 910 is disposed along front side at about the centerline 901. The fourth sized module housing planar member second opening 912 is disposed adjacent to the left side and the backside. The fourth sized module housing planar member third opening 914 is disposed adjacent to the right side and the back side. A plurality of side walls 916 extend upwards from the fourth sized module housing planar member upper side 906 and downward from the fourth sized module housing planar member lower side 908. The side walls 916 have, generally, either a uniform height or depth. The height of the fourth sized module upper side walls is between about ½ to 2.0 inches and preferably about 1.0 inch. The depth of the fourth sized module lower side walls is between about ⅛ to 1⅝ inches and preferably about ⅝ inches.

Figure 16A:
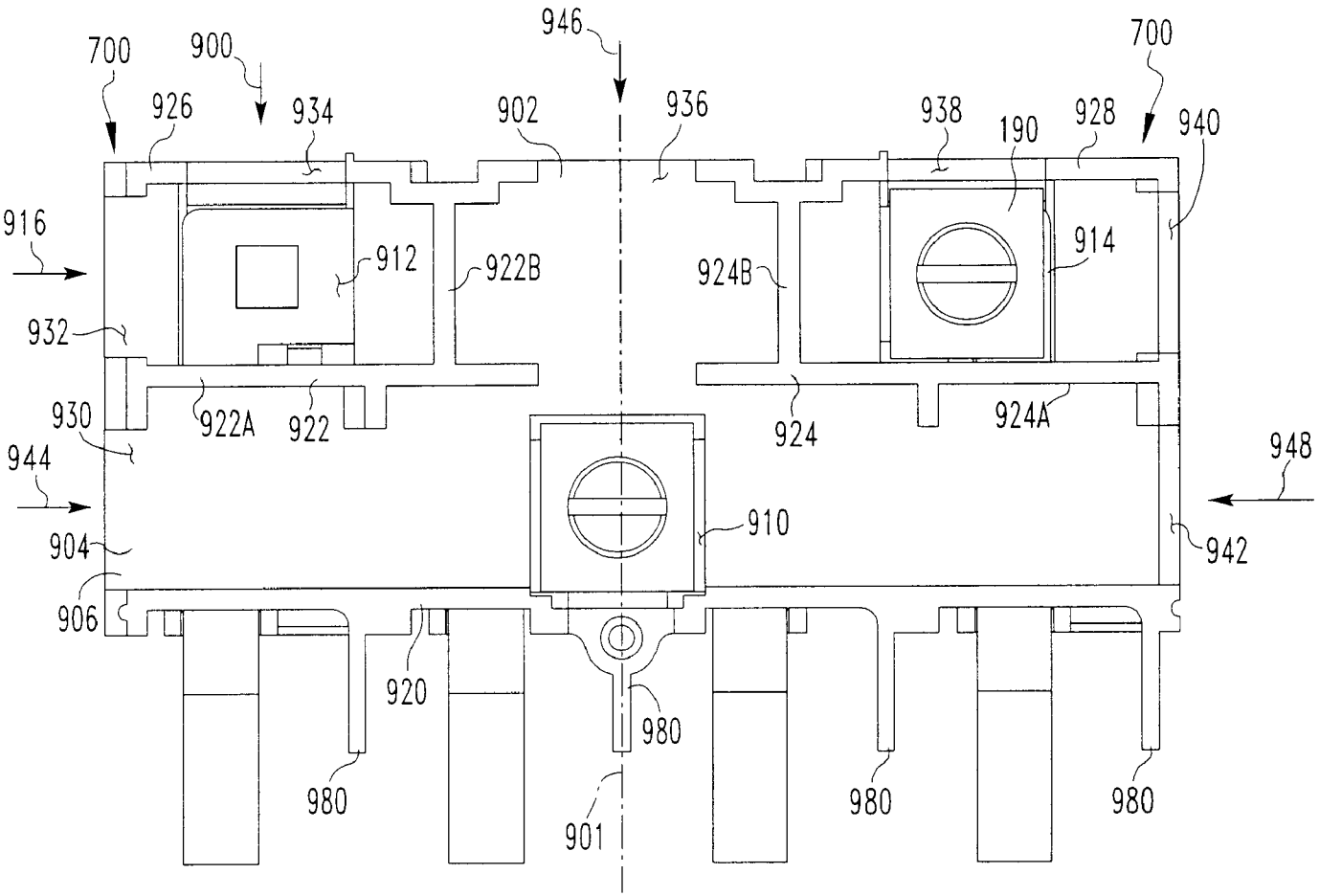
FIG. 16A is a top view of the fourth sized module.
Figure 16B:
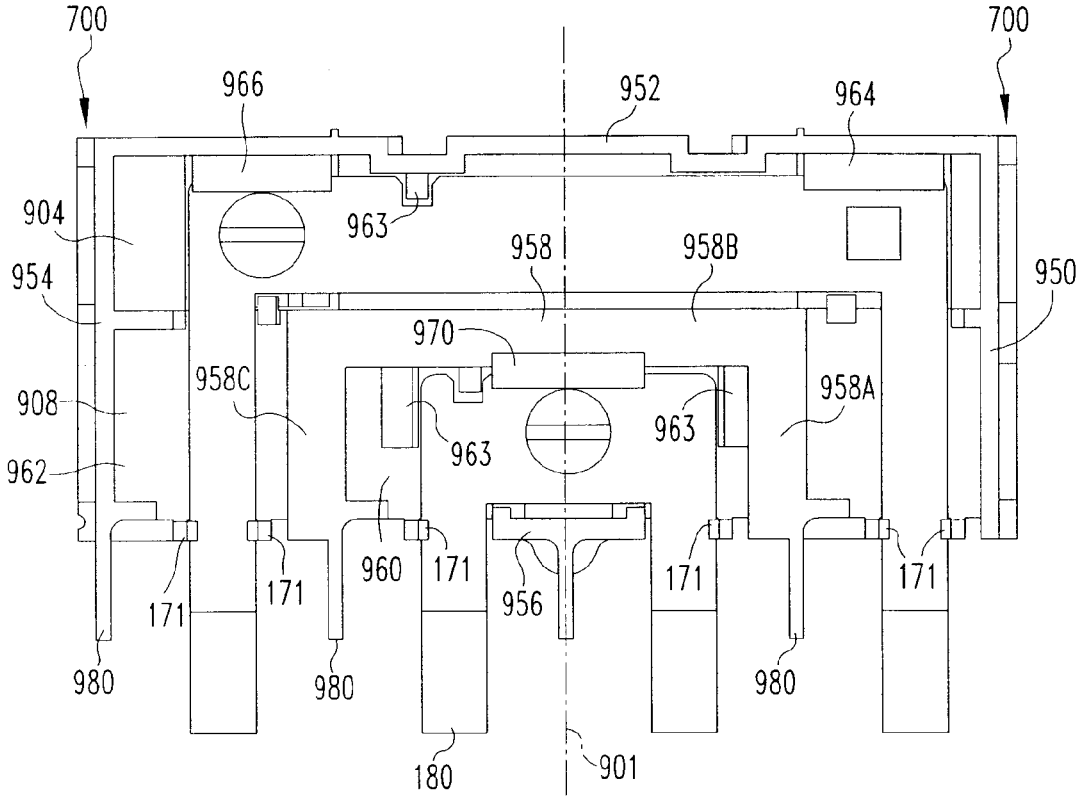
FIG. 16B is a bottom view of the fourth sized module.
Figure 16C:
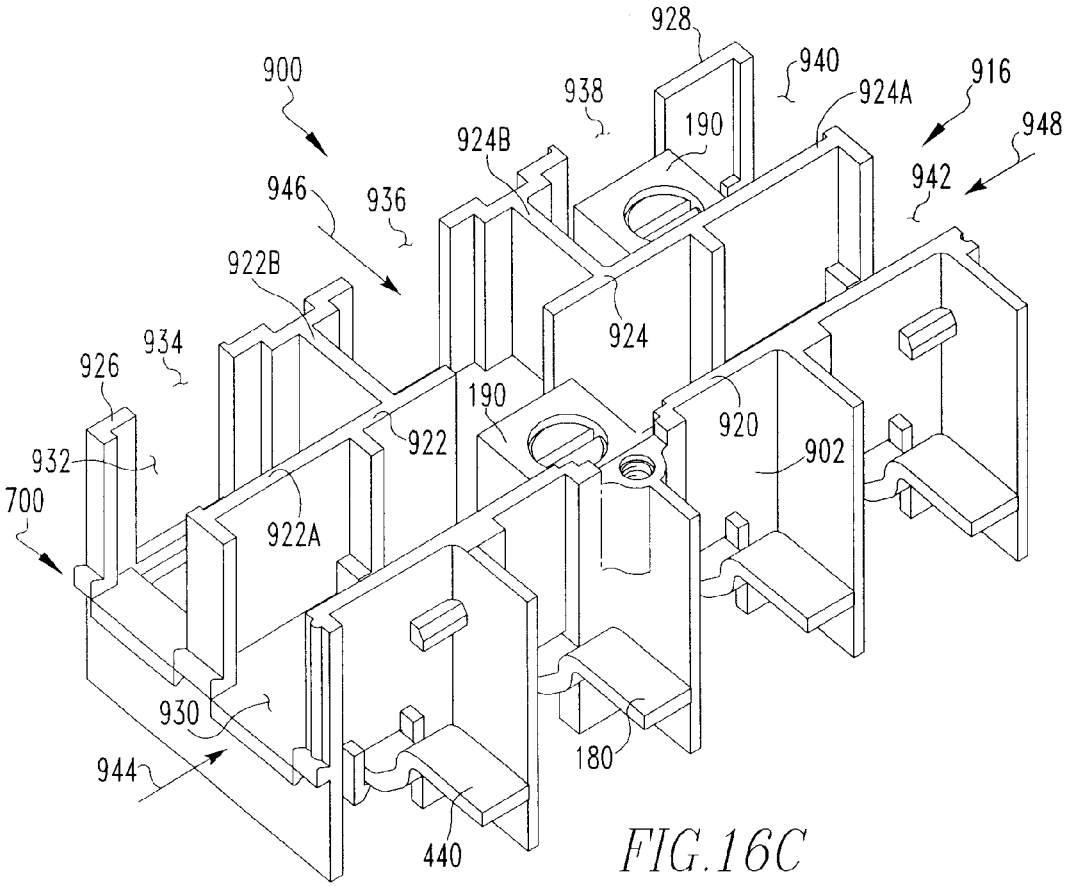

As shown in FIGS. 16A, 16C, the fourth sized module upper walls include a front side wall 920, a left L-shaped side wall 922, a right L-shaped side wall 924, a left back side wall 926 and a right back side wall 928. The fourth sized module upper front side wall 920 extends left to right along the front side of the fourth sized module housing planar member 904. The fourth sized module left L-shaped side wall 922 includes a first portion 922A, which extends left to right, and a second portion 922B which extends front to back. The fourth sized module left L-shaped side wall first portion 922A extends from a medial point on, and perpendicular to, the left side of the fourth sized module planar member 904 to a point generally between the fourth sized module housing planar member first opening 910 and the fourth sized module housing planar member second opening 912. The fourth sized module left L-shaped side wall second portion 922B extends from the point generally between the fourth sized module housing planar member first opening 910 and the fourth sized module housing planar member second opening 912 to the back side of the fourth sized module housing planar member 904. The fourth sized module right L-shaped side wall 924 includes a first portion 924A, which extends left to right, and a second portion 924B which extends front to back. The fourth sized module right L-shaped side wall first portion 924A extends from a medial point on, and perpendicular to, the right side of the fourth sized module planar member 904 to a point generally between the fourth sized module planar member first opening 910 and the fourth sized module planar member third opening 914. The right L-shaped side wall second portion 924B extends from the point generally between the fourth sized module planar member first opening 910 and the fourth sized module planar member third opening 914 to the back side of the fourth sized module planar member 904. The left back side wall 926 is disposed along the back side of fourth sized module planar member 904 and extends from the left side of the fourth sized module planar member 904. The fourth sized module right back side wall 928 is disposed along the back side of fourth sized module planar member 904 and extends from the right side of the fourth sized module planar member 904. Perpendicular tabs 929 may be disposed at the ends of the fourth sized module left L-shaped side wall 922 and fourth sized module right L-shaped side wall 924.

Thus, the fourth sized module upper side walls define a plurality of openings and raceways. There is a left side front opening 930 between the front side wall 920 and the fourth sized module left L-shaped side wall first portion 922A, a left side back opening 932 between the fourth sized module left L-shaped side wall first portion 922A and the left back side wall 926, a back side left opening 934 between the left back side wall 926 and the fourth sized module left L-shaped side wall second portion 922B, a medial back side opening 936 between the fourth sized module left L-shaped side wall second portion 922B and the fourth sized module right L-shaped side wall second portion 924B, a back side right opening 938 between the fourth sized module right L-shaped side wall second portion 924B and the right back side wall 928, a right side back opening 940 between the right back side wall 928 and the fourth sized module right L-shaped side wall first portion 924A, and a right side front opening 942 between the fourth sized module right L-shaped side wall first portion 924A and the front side wall 920. Additionally, the front side wall 920 and the fourth sized module left L-shaped side wall first portion 922A define a fourth sized module first raceway 944, the fourth sized module left L-shaped side wall second portion 922B and the fourth sized module right L-shaped side wall second portion 924B define a fourth sized module second raceway 946, the fourth sized module right L-shaped side wall first portion 924A and the front side wall 920 define a fourth sized module third raceway 948. Each of the fourth sized module raceways 944, 946, 948 provide an access path to the fourth sized module planar member first opening 910.

As shown in FIG. 16B, the fourth sized module lower side walls include lower left side wall 950, a lower back side wall 952, a lower right side wall 954, a lower front medial side wall 956, and a lower medial U-shaped side wall 958. The lower left side wall 950, lower back side wall 952, and lower right side wall 954 are disposed along, and extend the length of, the fourth sized module planar member 904 left side, back side, and right side, respectively. The lower front medial side wall 956 is disposed at about the centerline 901 and extends a short distance to the left and right of the centerline 901. The fourth sized module lower medial U-shaped side wall 958 includes a left extension 958A, a base portion 958B and a right extension 958C. The fourth sized module lower medial U-shaped wall left extension 958A begins at a point between the lower left side wall 950 and the lower front medial side wall 956 and extends perpendicular to the front side of the fourth sized module planar member 904 to a medial point on the fourth sized module planar member 904. The fourth sized module lower medial U-shaped wall right extension 958C begins at a point between the lower right side wall 954 and the lower front medial side wall 956 and extends perpendicular to the front side of the fourth sized module planar member 904 to a medial point on the fourth sized module planar member 904. The fourth sized module lower medial U-shaped wall base portion 958B extends left to right between the ends of the fourth sized module lower medial U-shaped side wall left extension 958A and fourth sized module lower medial U-shaped side wall right extension 958C. Thus, lower front medial side wall 956 and the fourth sized module lower medial U-shaped side wall 958 defines a first lower raceway 960, and the fourth sized module lower medial U-shaped wall 958 with the fourth sized module lower left side wall 950, fourth sized module lower back side wall 952, and fourth sized module lower right side wall 954 define a second lower raceway 962.

Bus assembly mounting bosses 964, 966, similar to those described above, are disposed on the front side of the fourth sized module lower back side wall 952. Another bus assembly mounting boss 970 is disposed on the front side of the fourth sized module lower medial U-shaped side wall base portion 958B. Additionally, bus assembly bus clips 171 are disposed at the front side of the fourth sized module first and second lower raceways 960, 962 and bus assembly alignment guides 963 are disposed within the fourth sized module first and second lower raceways 960, 962. A first sized module bus assembly is disposed in the fourth sized module first lower raceway 960 and is coupled to a collar assembly 190 being disposed through the fourth sized module planar member first opening 910. A second sized module bus assembly is disposed in the fourth sized module second lower raceway 962 and is coupled to a collar assembly 190 being disposed through the fourth sized module planar member second and/or third opening 912, 914.

A plurality of spacers 980 extend from the front side of the fourth sized module upper front side wall 920 and the lower front medial side wall 956 or as extensions of the lower side walls. The left and right sides of the fourth sized module housing assembly 902 have a tongue and groove connector 700 as described above. As such, the fourth sized module may be coupled to a third sized module 106. When coupled to a third sized module 106, the upper raceways are formed as described above.

Figure 17A:
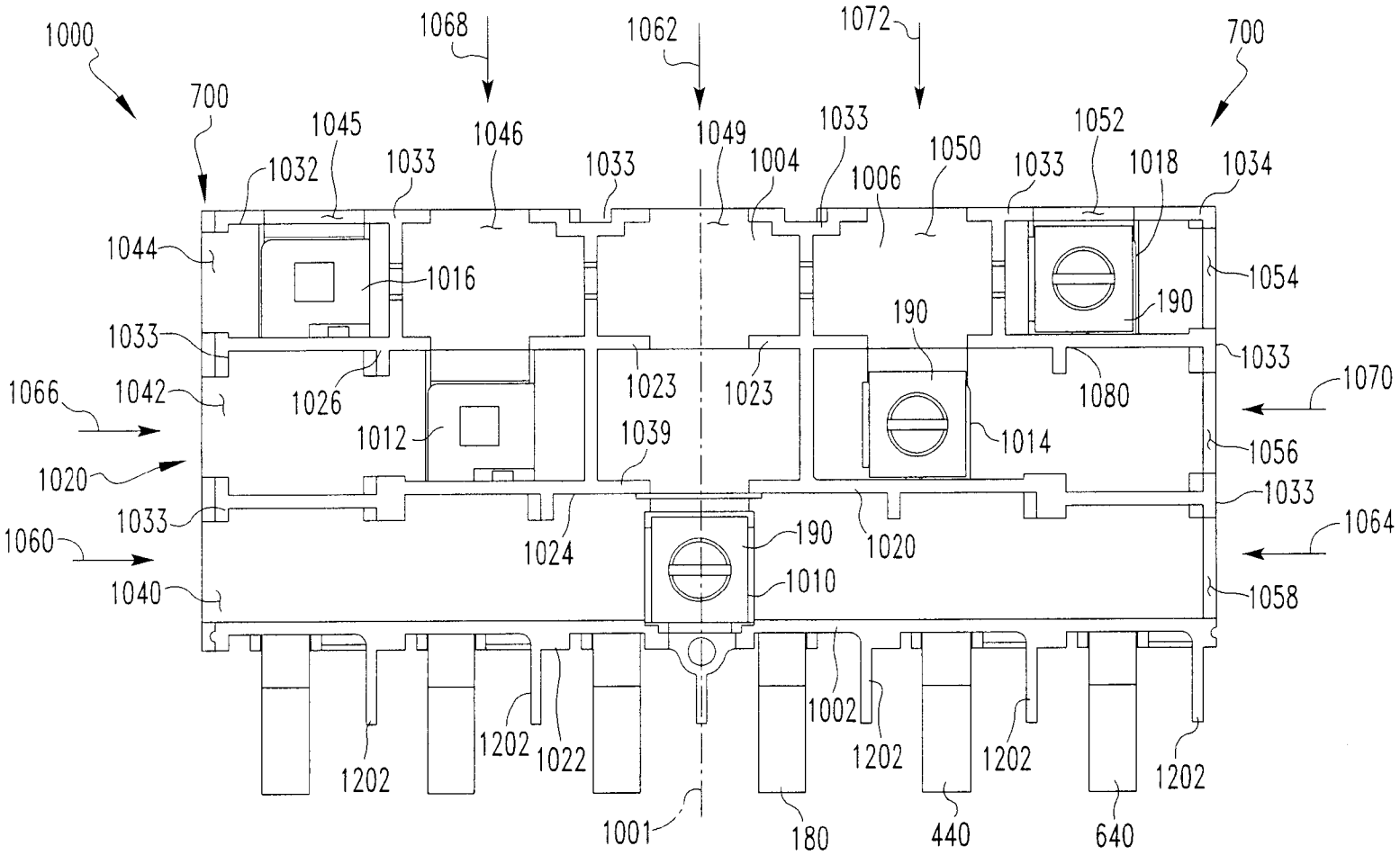
FIG. 17A is a top view of the full sized module.
Figure 17B:
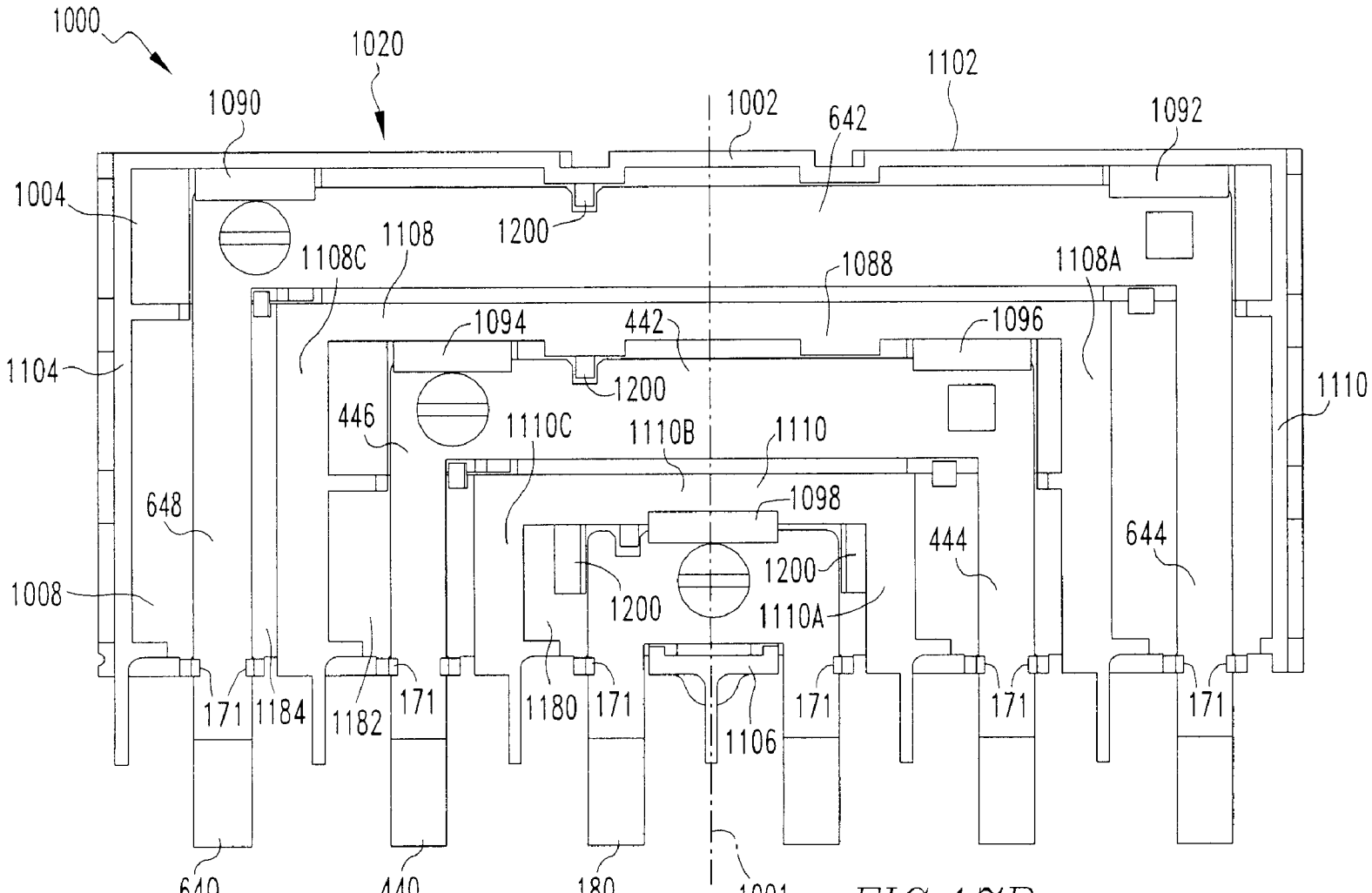
FIG. 17B is a bottom view of the full sized module.
Figure 17C:
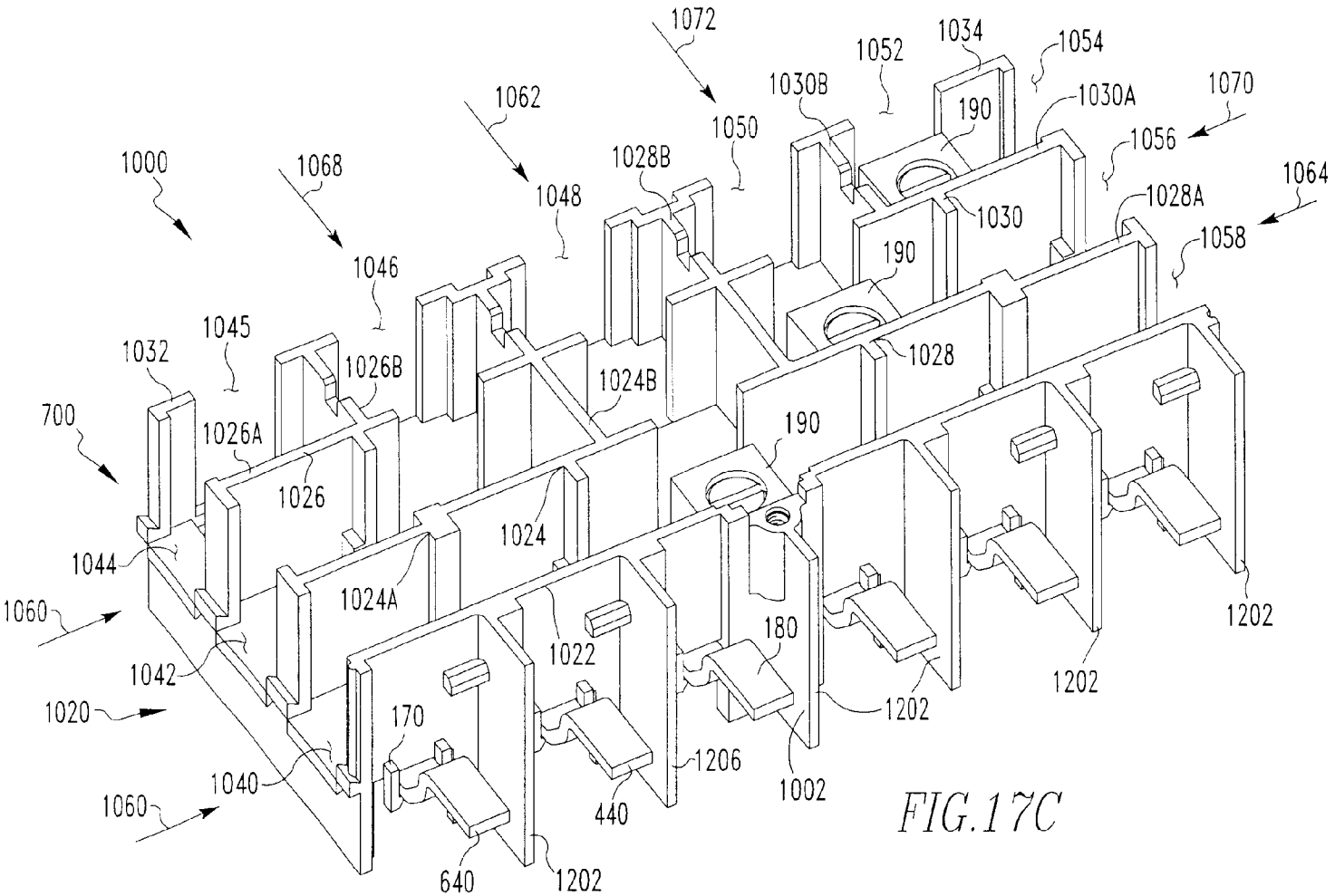
FIG. 17C is an exploded isometric view of the full sized module.

A second alternate jumper assembly is shown in FIGS. 17A–17C. The second alternate jumper assembly, hereinafter the full sized module 1000, is essentially, a single module that combines the features of the first sized module 102, the second sized module 104, and the third sized module 106. The full sized module 1000 includes a housing assembly 1002, a first sized module bus assembly 180, a second sized module bus assembly 440, and a third sized module bus assembly 640. The full sized module 1000 is generally symmetric about a centerline 1001. The full sized module housing assembly 1002 includes a planar member 1004 having an upper side 1006 and a lower side 1008. There are five openings 1010, 1012, 1014, 1016, 1018 extending through the full sized module housing planar member 1004. The full sized module planar member first opening 1010 is disposed along front side at about the centerline 1001. The full sized module planar member fourth opening 1016 is disposed adjacent to the left side and the backside. The full sized module planar member fifth opening 1018 is disposed adjacent to the right side and the backside. The full sized module planar member second opening 1012 is disposed at about the medial point between the full sized module planar member first opening 1010 and the full sized module planar member fourth opening 1016. The full sized module planar member third 1014 is disposed at about the medial point between the full sized module planar member first opening 1010 and the full sized module planar member fifth opening 1018. A plurality of side walls 1020 extend upwards from the full sized module planar member upper side 1006 and downward from the full sized module planar member lower side 1008. The side walls 1020 have, generally, either a uniform height or depth. The height of the full sized module upper side walls is between about ½ to 2.0 inches and preferably about 1.0 inch. The depth of the full sized module lower side walls is between about ⅛ to 1⅝ inches and preferably about ⅝ inches.

As shown in FIGS. 17A and 15C, the full sized module upper walls include a front side wall 1022, a front left L-shaped side wall 1024, a back left L-shaped side wall 1026, a front right L-shaped side wall 1028, a back right L-shaped side wall 1030, a left back side wall 1032 and a right back side wall 1034. The full sized module upper front side wall 1022 extends left to right along the front side of the full sized module planar member 1004. The full sized module front left L-shaped side wall 1024 includes a first portion 1024A, which extends left to right, and a second portion 1024B which extends front to back. The full sized module front left L-shaped side wall first portion 1024A extends from a point about one third of the distance between the front side and the back side of the full sized module housing planar member 1004 along, and perpendicular to, the left side of the full sized module planar member 1004 to a point generally between the full sized module planar member first opening 1010 and the full sized module planar member second opening 1012. The full sized module front left L-shaped side wall second portion 1024B extends from the point generally between the full sized module planar member first opening 1010 and the full sized module planar member second opening 1012 to the back side of the full sized module planar member 1004. The full sized module back left L-shaped side wall 1026 includes a first portion 1026A, which extends left to right, and a second portion 1026B which extends front to back. The full sized module back left L-shaped side wall first portion 1026A extends from a point about two-thirds of the distance between the front side and the back side of the full sized module housing planar member 1004 along, and perpendicular to, the left side of the full sized module planar member 1004 to a point generally between the full sized module planar member second opening 1012 and the full sized module planar member fourth opening 1016. The full sized module back left L-shaped side wall second portion 1026B extends from the point generally between the full sized module planar member second opening 1012 and the full sized module planar member fourth opening 1016 to the back side of the full sized module planar member 1004.

The full sized module front right L-shaped side wall 1028 includes a first portion 1028A, which extends left to right, and a second portion 1028B which extends front to back. The full sized module front right L-shaped side wall first portion 1028A extends from a point about one third of the distance between the front side and the back side of the full sized module housing planar member 1004 along, and perpendicular to, the right side of the full sized module planar member 1004 to a point generally between the full sized module planar member first opening 1010 and the full sized module planar member third opening 1014. The front right L-shaped side wall second portion 1028B extends from the point generally between the full sized module planar member first opening 1010 and the full sized module planar member third opening 1014 to the back side of the full sized module planar member 1004. The full sized module back right L-shaped side wall 1030 includes a first portion 1030A, which extends right to right, and a second portion 1030B which extends front to back. The full sized module back right L-shaped side wall first portion 1030A extends from a point about two-thirds of the distance between the front side and the back side of the full sized module housing planar member 1004 along, and perpendicular to, the right side of the full sized module planar member 1004 to a point generally between the full sized module planar member third opening 1014 and the full sized module planar member fifth opening 1018. The back right L-shaped side wall second portion 1030B extends from the point generally between the full sized module planar member third opening 1014 and the full sized module planar member fifth opening 1018 to the back side of the full sized module planar member 1004.

The left back side wall 1032 is disposed along the back side of full sized module planar member 1004 and extends from the left side of the full sized module planar member 1004. The right back side wall 1034 is disposed along the back side of full sized module planar member 1004 and extends from the right side of the full sized module planar member 1004. Perpendicular tabs 1033 may be disposed at the ends of the full sized module front left L-shaped side wall 1024, the full sized module back left L-shaped side wall 1026, the full sized module front right L-shaped side wall 1028, and the full sized module back right L-shaped side wall 1030.

Thus, the full sized module upper side walls define a plurality of openings and raceways. There is a front left side opening 1040 between the full sized module front side wall 1022 and the full sized module front left L-shaped side wall first portion 1024A, a left side medial opening 1042 between the full sized module front left L-shaped side wall first portion 1024A and the back left L-shaped side wall first portion 1026A, a back left side opening 1044 between the back left L-shaped side wall first portion 1026A and the left back side wall 1032, a back side left opening 1045 between the left back side wall 1032 and the back left L-shaped side wall second portion 1026B, a back side left medial opening 1046 between the back left L-shaped side wall second portion 1026B and the front left L-shaped side wall second portion 1024B, a back side medial opening 1048 between the front left L-shaped side wall second portion 1024B and the front right L-shaped side wall second portion 1028B, a back side right medial opening 1050 between the front right L-shaped side wall second portion 1028B and the back right L-shaped side wall second portion 1030B, a back side right opening 1052 between the back right L-shaped side wall second portion 1030B and the right back side wall 1034, a right side back opening 1054 between the right back side wall 1034 and the back right L-shaped side wall first portion 1030A, a right side medial opening 1056 between the back right L-shaped side wall first portion 1030A and the front right L-shaped side wall first portion 1028A, and a right side front opening 1058 between the front right L-shaped side wall first portion 1028A and the full sized module front side wall 1022.

Additionally, the full sized module front side wall 1022 and the full sized module front left L-shaped side wall first portion 1024A define a full sized module first upper raceway 1060. The front left L-shaped side wall second portion 1024B and the front right L-shaped side wall second portion 1028B define a full sized module second upper raceway 1062. The full sized module front side wall 1022 and the front right L-shaped side wall first portion 1028A define a full sized module third upper raceway 1064. The full sized module front left L-shaped side wall first portion 1024A and the full sized module back left L-shaped side wall first portion 1026A define a full sized module fourth upper raceway 1066. The full sized module front left L-shaped side wall second portion 1024B and the full sized module back left L-shaped side wall second portion 1026B define a full sized module fifth upper raceway 1068. The full sized module front right L-shaped side wall first portion 1028A and the full sized module back right L-shaped side wall first portion 1030A define a full sized module sixth upper raceway 1070. The full sized module front right L-shaped side wall second portion 1028B and the full sized module back right L-shaped side wall second portion 1030B define a full sized module seventh upper raceway 1072. The full sized module first, second and third upper raceways 1060, 1062, 1064 provide an access path to the full sized module planar member first opening 1010. The full sized module fourth and fifth upper raceways 1066, 1068 provide an access path to the full sized module planar member second opening 1012. The full sized module sixth and seventh upper raceways 1070, 1072 provide an access path to the full sized module planar member third opening 1014.

As shown in FIG. 17B, the full sized module lower side walls include lower left side wall 1100, a lower back side wall 1102, a lower right side wall 1104, a lower front medial side wall 1106, lower outer medial U-shaped side wall 1108, and a lower inner medial U-shaped side wall 1110. The lower left side wall 1100, lower back side wall 1102, and lower right side wall 1104 are disposed along, and extend the length of, the full sized module planar member 1004 left side, back side, and right side, respectively. The lower front medial side wall 1106 is disposed at about the centerline 1001 and extends a short distance to the left and right of the centerline 1001. The full sized module lower outer medial U-shaped side wall 1108 includes a left extension 1108A, a base portion 1108B and a right extension 1108C. The full sized module lower outer medial U-shaped side wall left extension 1108A is spaced from the full sized module lower left side wall 1100 by about twice the width of the third sized module bus planar member left extension 644. The full sized module lower outer medial U-shaped wall left extension 1108A begins at the front side and extends toward the back to a point spaced about the width of the third sized module bus planar member base portion 642 from the full sized module lower back side wall 1102. The full sized module lower outer medial U-shaped wall right extension 1108C is spaced from the lower right side wall 1104 by about twice the width of the third sized module bus planar member right extension 646. The full sized module lower outer medial U-shaped wall right extension 1108C begins at the front side and extends toward the back to a point spaced about the width of the third sized module bus planar member base portion 642 from the full sized module lower back side wall 1102. The full sized module lower outer medial U-shaped wall base portion 1108B extends left to right between the back side ends of the full sized module lower outer medial U-shaped wall left extension 1108A and full sized module lower outer medial U-shaped wall right extension 1108C.

The full sized module lower inner medial U-shaped side wall 1110 includes a left extension 1110A, a base portion 1110B and a right extension 1110C. The full sized module lower inner medial U-shaped wall left extension 1110A is spaced from the lower outer medial left extension side wall 1108A by about twice the width of the second sized module bus planar member left extension 444. The full sized module lower inner medial U-shaped wall left extension 1110A begins at the front side and extends toward the back to a point spaced about the width of the second sized module bus planar member base portion 442 from full sized module lower outer medial U-shaped side wall base portion 1108B. The full sized module lower inner medial U-shaped side wall right extension 1110C is spaced from the lower outer medial U-shaped side wall right extension 1108C by about twice the width of the second sized module bus planar member left extension 446. The full sized module lower inner medial U-shaped wall right extension 1110C begins at the front side and extends toward the back to a point spaced about the width of the second sized module bus planar member base portion 442 from full sized module lower outer medial U-shaped wall base portion 1108B. The full sized module lower inner medial U-shaped wall base portion 1110B extends left to right between the back side ends of the full sized module lower inner medial U-shaped wall left extension 1110A and full sized module lower inner medial U-shaped wall right extension 1110C.

Thus, lower front medial side wall 1106 and the full sized module lower inner medial U-shaped side wall 1110 define a first lower raceway 1180, the full sized module lower inner medial U-shaped side wall 1110 with the full sized module lower outer medial U-shaped side wall 1108 define a second lower raceway 1182, and the full sized module lower outer medial U-shaped side wall 1108 along with the full sized module lower left side wall 1100, full sized module lower back side wall 1102, and full sized module lower right side wall 1104 define a third lower raceway 1184.

Bus assembly mounting bosses 1090, 1092, similar to those described above, are disposed on the front side of the full sized module lower back side wall 1102. Two more bus assembly mounting bosses 1094, 1096 are disposed on the front side of the lower outer medial U-shaped side wall base portion 1108B, and one bus assembly mounting boss 1098 is disposed on the front side of the full sized module lower inner medial U-shaped wall base portion 1110B. Additionally, bus assembly bus clips 171 are disposed at the front side of the full sized module first, second, and third lower raceways 1180, 1182, 1184 and bus assembly alignment guides 1200 are disposed within the full sized module first, second, and third lower raceways 1180, 1182, 1184.

A first sized module bus assembly 180 is disposed in the full sized module first lower raceway 1180 and is coupled to a collar assembly 190 being disposed through the full sized module planar member first opening 1010. A second sized module bus assembly 440 is disposed in the full sized module second lower raceway 1182 and is coupled to a collar assembly 190 being disposed through the full sized module planar member second and/or third opening 1012, 1014. A third sized module bus assembly 640 is disposed in the full sized module third lower raceway 1184 and is coupled to a collar assembly 190 being disposed through the full sized module planar member fourth and/or fifth opening 1016, 1018. A plurality of spacers 1202 extend from the front side of the full sized module upper front side wall 1022 and the lower front medial side wall 1106 or as extensions of the lower side walls. The left and right sides of the full sized module housing assembly 1002 have a tongue and groove connector 700 as described above. As such, the full sized module may be coupled to another full sized jumper module 1000 or to a modular jumper assembly 100.

Figure 18:
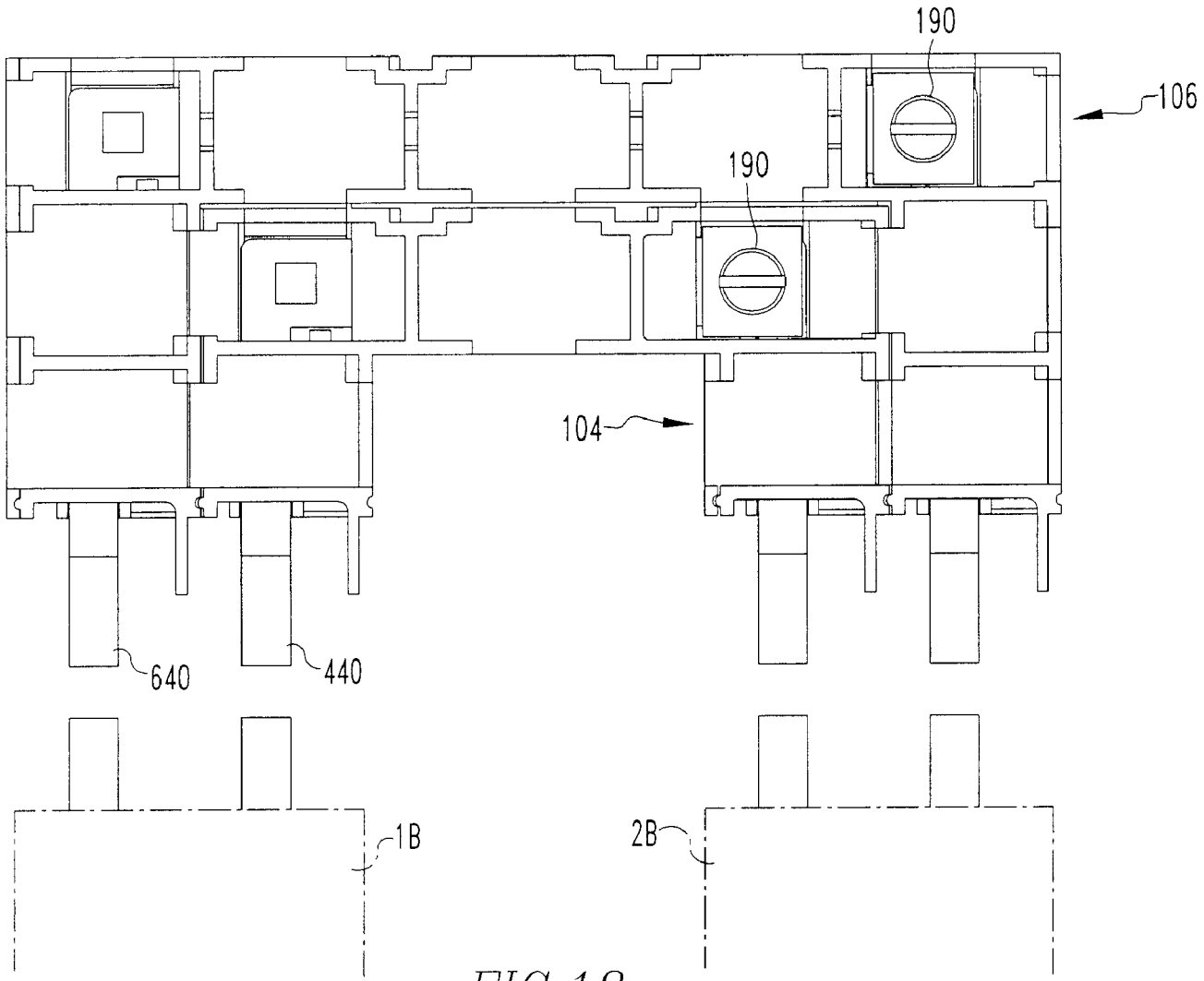
FIG. 18 is a top view of an alternate configuration of the jumper assembly.

The modular design allows for jumper assemblies of various sizes to be constructed. For example, the third sized module 106 may be omitted when the modular jumper assembly 100 is to be used with a two power line system in conjunction with two adjacent circuit breakers. Alternatively, if the circuit breakers are spaced from each other, the jumper assembly 100 may be configured using a second sized module 104 and a third sized module 106, as shown in FIG. 18.

Additionally, the modular jumper assemblies 100 may be linked together in a multi-jumper assembly configuration 1248. That is, as shown in FIG. 19, a first modular jumper assembly 100A, disposed on the left, may be coupled, both mechanically and electrically, to a second modular jumper assembly 100B, or to full sized jumper module 1000, disposed to the right. The modular jumper assemblies 100A, 100B are linked mechanically by the tongue-and-groove connector 700 disposed on the right side of the first modular jumper assembly 100A and the left side of the second modular jumper assembly 100B. That is, as described above, the right side of the first modular jumper assembly 100A has the bisected groove portion of the tongue-and-groove connector 700 while the left side of the second modular jumper assembly 100B incorporates the bisected tongue portion of the tongue-and-groove connector 700.

The first and second modular jumper assemblies 100A, 100B are further coupled together by conductive bus straps 1250A, 1250B, 1250C. The bus straps 1250A, 1250B, 1250C are coupled to the collar assemblies 190 of each bus assembly 180, 440, 640. On the second sized module and third sized module bus assemblies 440, 640, the bus straps 1250, preferably, are coupled to a collar assembly 190 that is not coupled to a power line, e.g., power line 1260. That is, as shown, power lines 1260, 1262, 1264 are coupled to the first modular jumper assembly 100A first sized module bus assembly 180, the second sized module bus assembly 440, and the third sized module bus assembly 640, respectively. Both the second sized module bus assembly 440 and the third sized module bus assembly 640 include a left side collar assembly 190 and a right side collar assembly 190. The power line 1264 extends through the third sized module upper left raceway 850 and is coupled to the left collar assembly 190 on the third sized module bus assembly 640. A third sized module bus strap 1250C is coupled to the right collar assembly 190 on the first modular jumper assembly 100A third sized module bus assembly 640 and to the left collar on the second modular jumper assembly 100A third sized module bus assembly 640. The third sized module bus strap 1250C extends through the first modular jumper assembly 100A third sized module upper right raceway 856 and through the second modular jumper assembly 100B third sized module upper left raceway 850. Similarly, the power line 1262 extends through the second sized module upper left raceway 840 and is coupled to the left collar assembly 190 on the second sized module bus assembly 440. A second sized module bus strap 1250B is coupled to the right collar assembly 190 on the first modular jumper assembly 100A second sized module bus assembly 440 and to the left collar assembly 190 on the second modular jumper assembly 100A second sized module bus assembly 440. The second sized module bus strap 1250B extends through the first modular jumper assembly 100A second sized module upper right raceway 846 and through the second modular jumper assembly 100B second sized module upper left raceway 840.

Because the first sized module bus assembly 180 has only one collar assembly 190, the power line 1260 and a first sized module bus strap 1250A require a generally flat terminal end 1249 so that the single first sized module bus assembly collar 190 may accommodate both. The power line 1260 extends through the first modular jumper assembly

100A first sized module bus assembly upper left raceway 830. The first sized module bus strap 1250A extends through the first modular jumper assembly 100A first sized module bus assembly upper right raceway 832 and through the second modular jumper assembly 100B first sized module bus assembly upper left raceway 830. Additional modular jumper assemblies 100 may be coupled to the first and second jumper assemblies 100A, 100B in a similar manner. Thus, one set of power lines may be couple to an infinite number of modular jumper assemblies 100.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A modular jumper assembly comprising:

a first sized module having a housing assembly and a bus assembly;

a second sized module having a housing assembly and a bus assembly;

said first sized module and said second sized module structured to be coupled together;

said first sized module housing assembly having a planar member and plurality of side walls, said planar member having at least one opening therethrough;

said second sized module housing assembly having a planar member and a plurality of side walls, said planar member having at least one opening therethrough;

said first sized module lower side walls forming a first sized module lower raceway;

said second sized module lower side walls forming a second sized module lower raceway;

said first sized module upper side walls and said second sized module upper side walls cooperating to form a plurality of upper access raceways;

wherein said lower raceways are separated from said upper raceways by each said housing assembly planar member;

whereby separate power lines may pass through a said separate upper raceways to be coupled to each bus assembly;

wherein each bus assembly includes a planar member, and a collar assembly;

each said planar bus planar member disposed in a lower raceway;

each said collar assembly disposed in an upper raceway and coupled to said bus assembly planar member through said housing assembly planar member opening;

wherein one or more upper raceways provide access to the first sized module bus assembly collar;

one or more upper raceways provide access to the second sized module bus assembly collar;

said first sized module upper raceways are separate from said second sized module upper raceways;

wherein said first sized module raceways include a first sized module left access raceway, a first sized module right access raceway, and a first sized module back medial access raceway;

said second sized module raceways include a left access raceway, a back side left access raceway, a back side right access raceway, and a right access raceway;

wherein said first sized module housing planar member has a generally rectangular shape;

said first sized module lower side walls include a first sized module lower left side wall, a first sized module lower back side wall, a first sized module lower right side wall and a first sized module lower front medial side wall;

said first sized module lower left side wall, first sized module lower back side wall and first sized module lower right side wall extending generally along the entire perimeter of said first sized module housing planar member;

said first sized module lower front side wall extending over the medial portion of said first sized module planar member front side;

whereby said first sized module lower side walls form a first sized module lower raceway;

said first sized module bus assembly planar member is disposed within said first sized module lower raceway;

wherein said second sized module housing planar member has a U- shape with a base portion, a left extension and a right extension;

said second sized module lower side walls include a second sized module left extension lower left side wall, a second sized module left extension lower right side wall, a second sized module right extension lower right side wall, a second sized module right extension lower left side wall, a second sized module base portion lower left side wall, a second sized module base portion lower right side wall, and a second sized module base portion lower back side wall;

whereby said second sized module lower side walls form a second sized module lower raceway; and said second sized module bus assembly planar member is disposed within said second sized module lower raceway.

2. The jumper assembly of claim 1, wherein said first sized module upper side walls include a front side wall, a left back side wall and a right back side wall;

said first sized module upper side walls defining a left side opening between the front side wall and the left back side wall, a medial back opening between the left back side wall and the right back side wall, and a right side opening between the front side wall and the right back side wall.

3. The jumper assembly of claim 2, wherein said second sized module upper side walls include a left front side wall disposed at the front side of the left extension, a right front side wall disposed at the front of the right extension, a left medial side wall disposed between the base portion and the left extension, a right medial side wall disposed between the base portion and the right extension, a left back side wall disposed along the left back side of the base portion, a right back side wall disposed along the right back side of the base portion, a base portion left medial side wall extending front to back and a base portion right medial side wall extending front to back; and said second sized module upper side walls defining a second sized module left extension left opening and a second sized module left extension right opening between the left front side wall and the left medial wall, a second sized module right extension left and right openings between the right front side wall and the right medial wall, a second sized module base portion left side opening between the left medial side wall and the left back side wall, a left back opening between the left back side wall and the base portion left medial side wall, a medial back side opening and a medial front side opening each between the base portion left medial side wall and the base portion right medial side wall, a right back opening between the base portion right medial side wall and the right back side wall, and a base portion right side opening between the right back side wall and the right medial side wall.

* * * * *